US011643816B2

(12) United States Patent
Sato et al.

(10) Patent No.: US 11,643,816 B2
(45) Date of Patent: May 9, 2023

(54) ROOF PANEL, ROOF STRUCTURE, AND ROOF STRUCTURE CONSTRUCTION METHOD

(71) Applicant: SEKISUI HOUSE, LTD., Osaka (JP)

(72) Inventors: Ryosuke Sato, Osaka (JP); Takeshi Nakagawa, Osaka (JP); Fukutaro Asai, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 145 days.

(21) Appl. No.: 17/287,224

(22) PCT Filed: Apr. 15, 2020

(86) PCT No.: PCT/JP2020/016627
§ 371 (c)(1),
(2) Date: Apr. 21, 2021

(87) PCT Pub. No.: WO2020/218128
PCT Pub. Date: Oct. 29, 2020

(65) Prior Publication Data

US 2021/0381233 A1 Dec. 9, 2021

(30) Foreign Application Priority Data

Apr. 22, 2019 (JP) ..... JP2019-081331
Apr. 8, 2020 (JP) ..... JP2020-069480

(51) Int. Cl.
*E04B 7/04* (2006.01)

(52) U.S. Cl.
CPC ..... *E04B 7/04* (2013.01)

(58) Field of Classification Search
CPC . E04B 7/02; E04B 7/022; E04B 7/024; E04B 7/026; E04B 7/04; E04B 7/06;
(Continued)

(56) References Cited

U.S. PATENT DOCUMENTS 2,737,267 A * 3/1956 Koch ..... E04D 3/3605 269/254 R
5,570,555 A * 11/1996 Ferguson ..... E04D 12/004 52/550
(Continued)

FOREIGN PATENT DOCUMENTS

JP 1992-363449 A 12/1992
JP 1995-286394 A 10/1995
(Continued)

OTHER PUBLICATIONS

International Search Report and Written Opinion issued in PCT/JP2020/016627.

*Primary Examiner* — Kyle J. Walraed-Sullivan
(74) *Attorney, Agent, or Firm* — McClure, Qualey & Rodack, LLP

(57) ABSTRACT

A roof structure includes: horizontal base materials forming a roof slope; and roof panels fixed on the horizontal base materials and spread side by side in a slope direction, each of the roof panels includes a roofing board, and rafters fixed to a lower surface of the roofing board in parallel to each other, and extending perpendicularly to the horizontal base materials, each of the rafters of one of the two adjacent roof panels in the slope direction includes a carry-out portion projecting from an edge of the roofing board, each of the carry-out portions being between the rafters of the other roof panel and fixed to the roofing board of the other roof panel, a projection length of the carry-out portions is smaller than a distance between the adjoining horizontal base materials, and the carry-out portions and the other roof panel are fixed to the same horizontal base material.

20 Claims, 26 Drawing Sheets

(58) Field of Classification Search
CPC ... E04B 7/08; E04B 7/10; E04B 7/102; E04B 7/105; E04D 2001/3423; E04D 2001/3447; E04D 2001/345; E04D 2001/3461; E04D 2001/3473; E04D 3/02; E04D 3/08; E04D 3/16; E04D 3/603; E04D 3/3605; E04D 3/3606; E04D 2003/0868; E04D 2003/0806; E04D 2003/0812; E04D 2003/0875; E04D 2003/0881; E04D 2003/0887
See application file for complete search history.

(56) References Cited

U.S. PATENT DOCUMENTS 5,642,596 A * 7/1997 Waddington ..... E04D 12/004 52/550
5,765,324 A * 6/1998 Schultz ..... E04D 3/08 52/669
2003/0051419 A1 * 3/2003 Suzuki ..... E04D 3/30 52/198

FOREIGN PATENT DOCUMENTS

JP 1998-46737 A 2/1998
JP 2011-32755 A 2/2011

* cited by examiner

[FIG. 1]
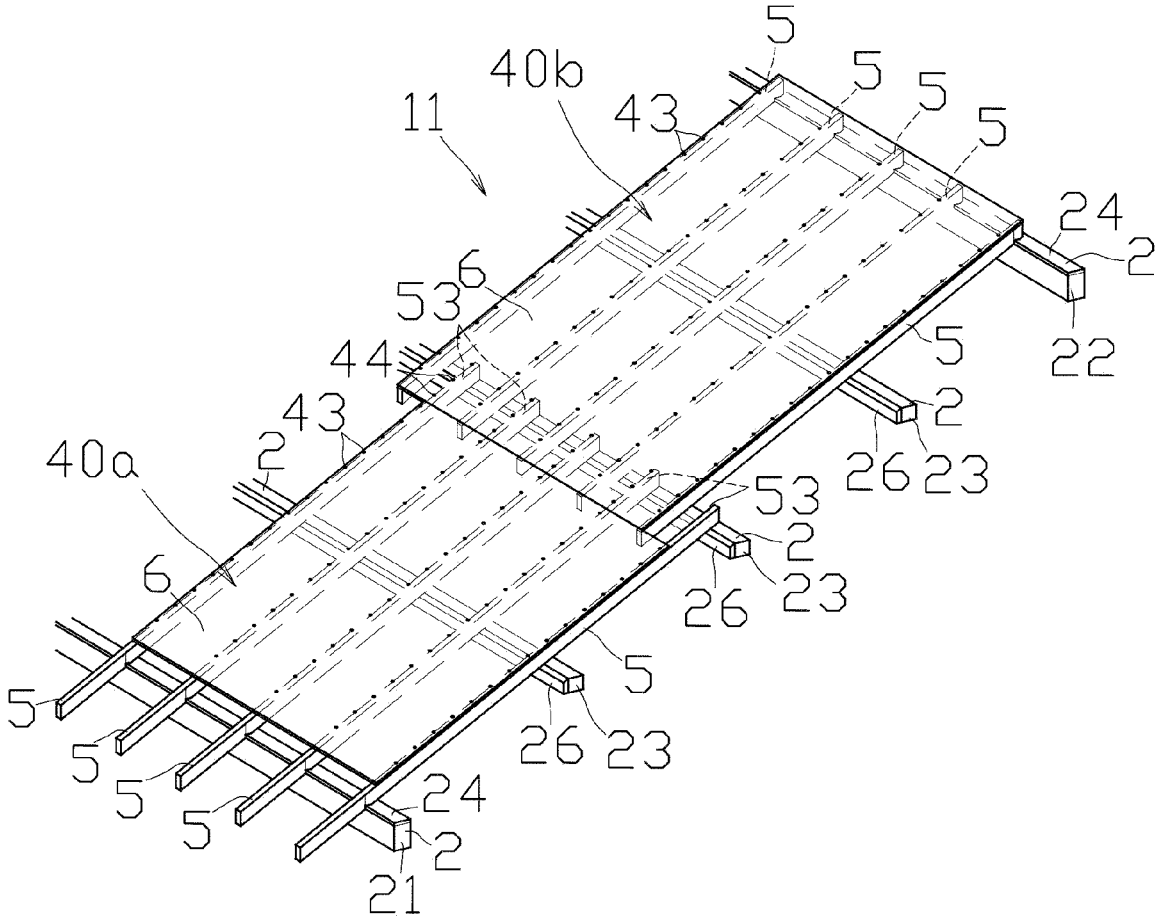

[FIG. 2]
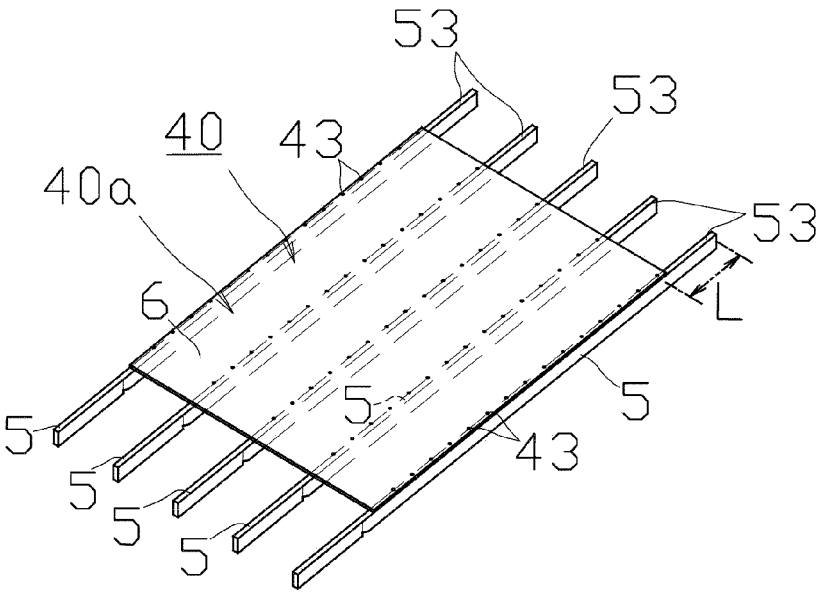

[FIG. 3]
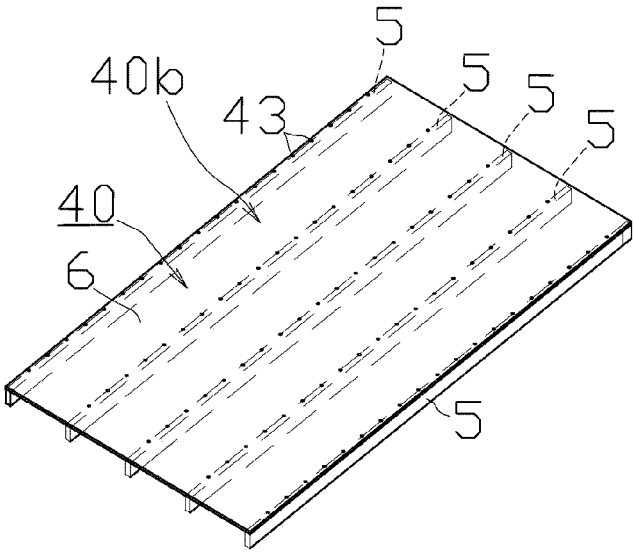

[FIG. 4]
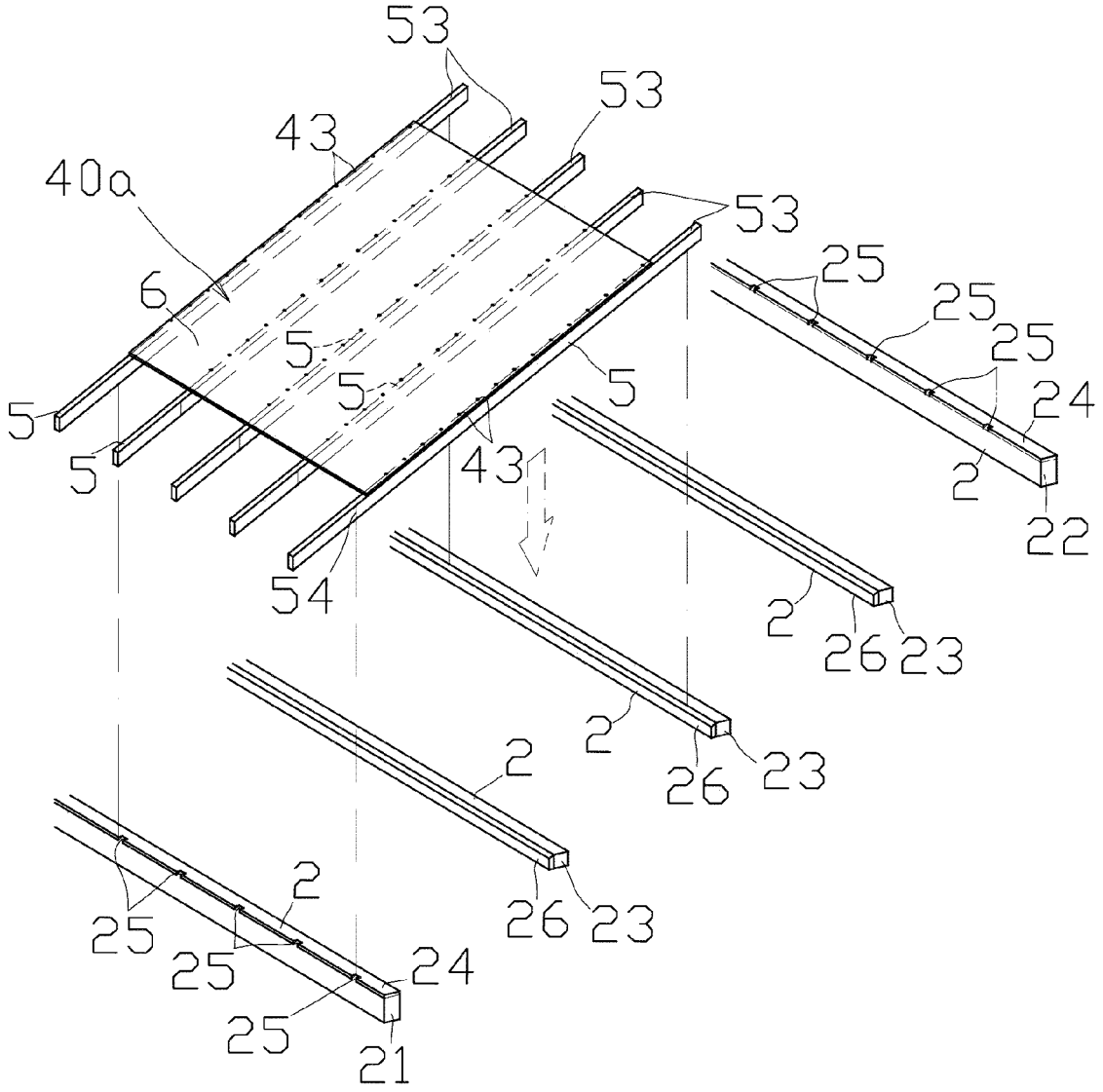

[FIG. 5]
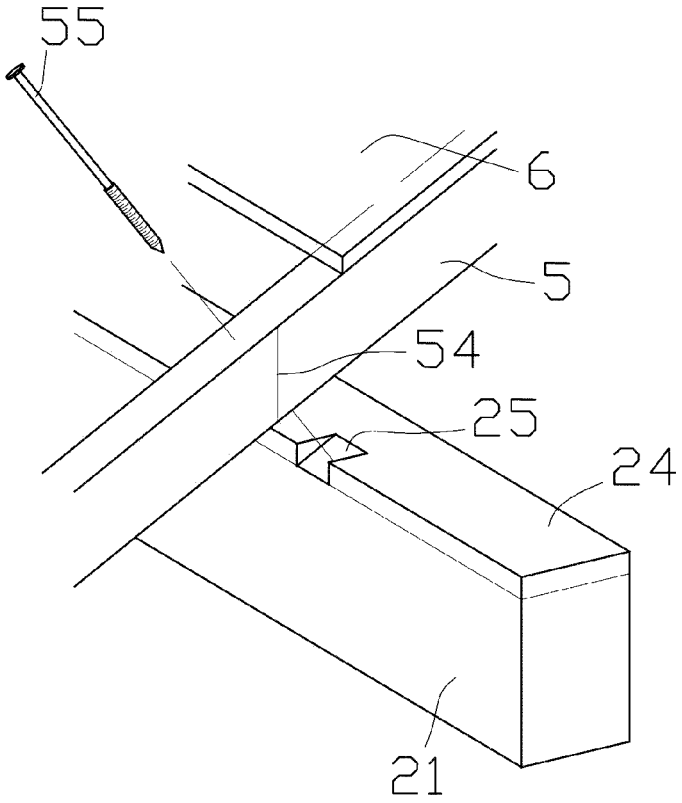

[FIG. 6]
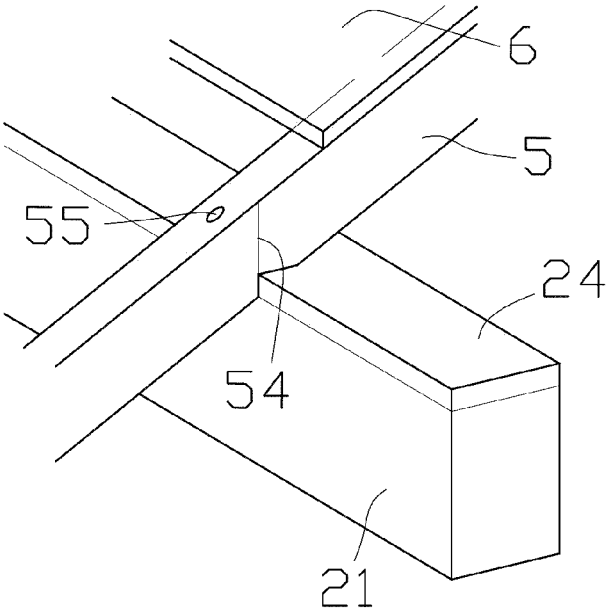

[FIG. 7]
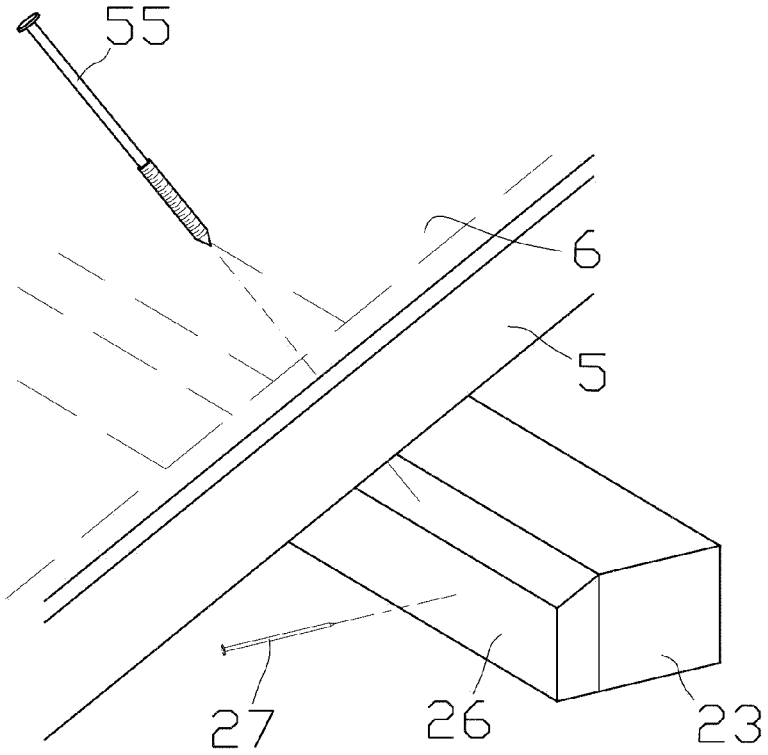

[FIG. 8]
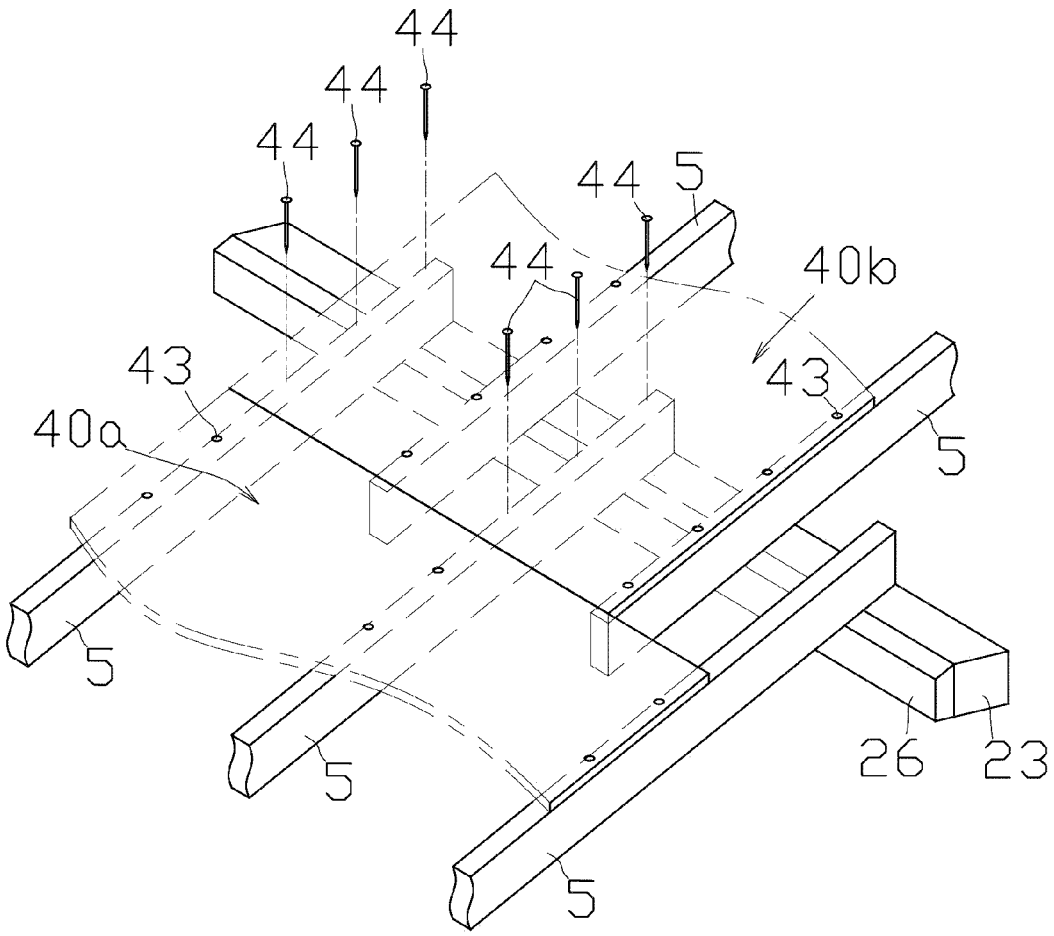

[FIG. 9]
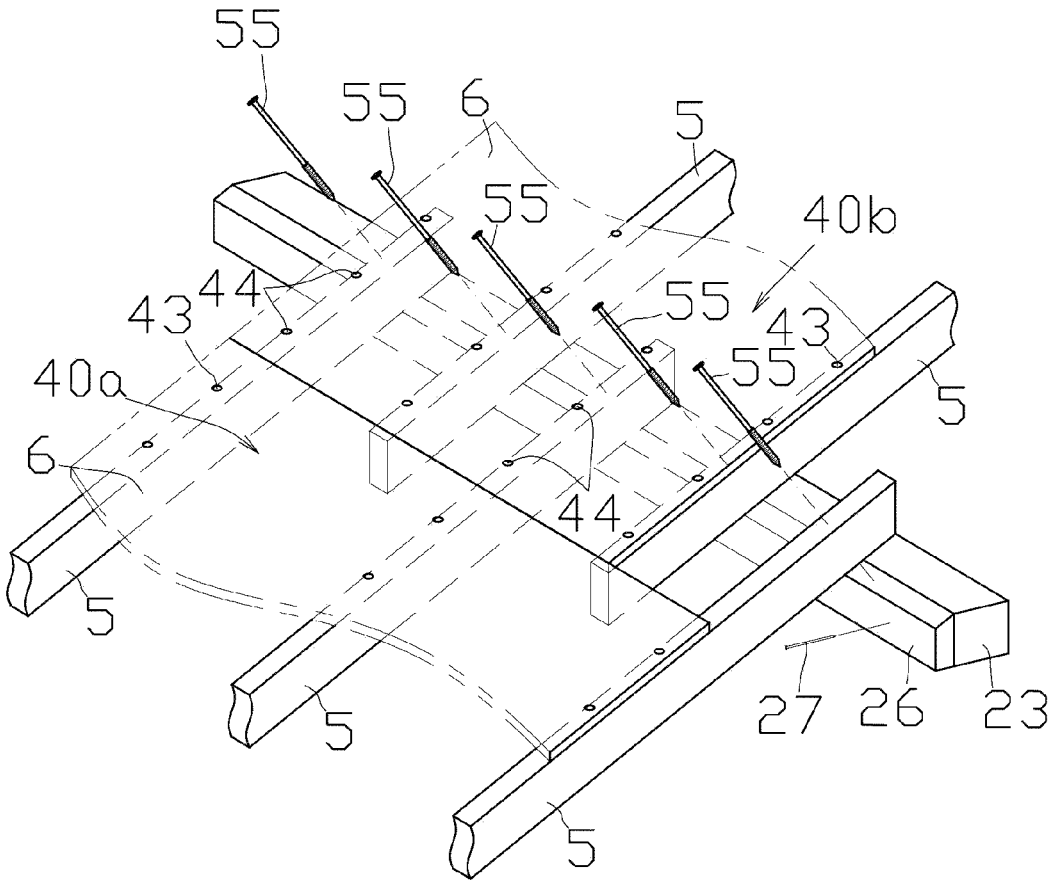

[FIG. 10]
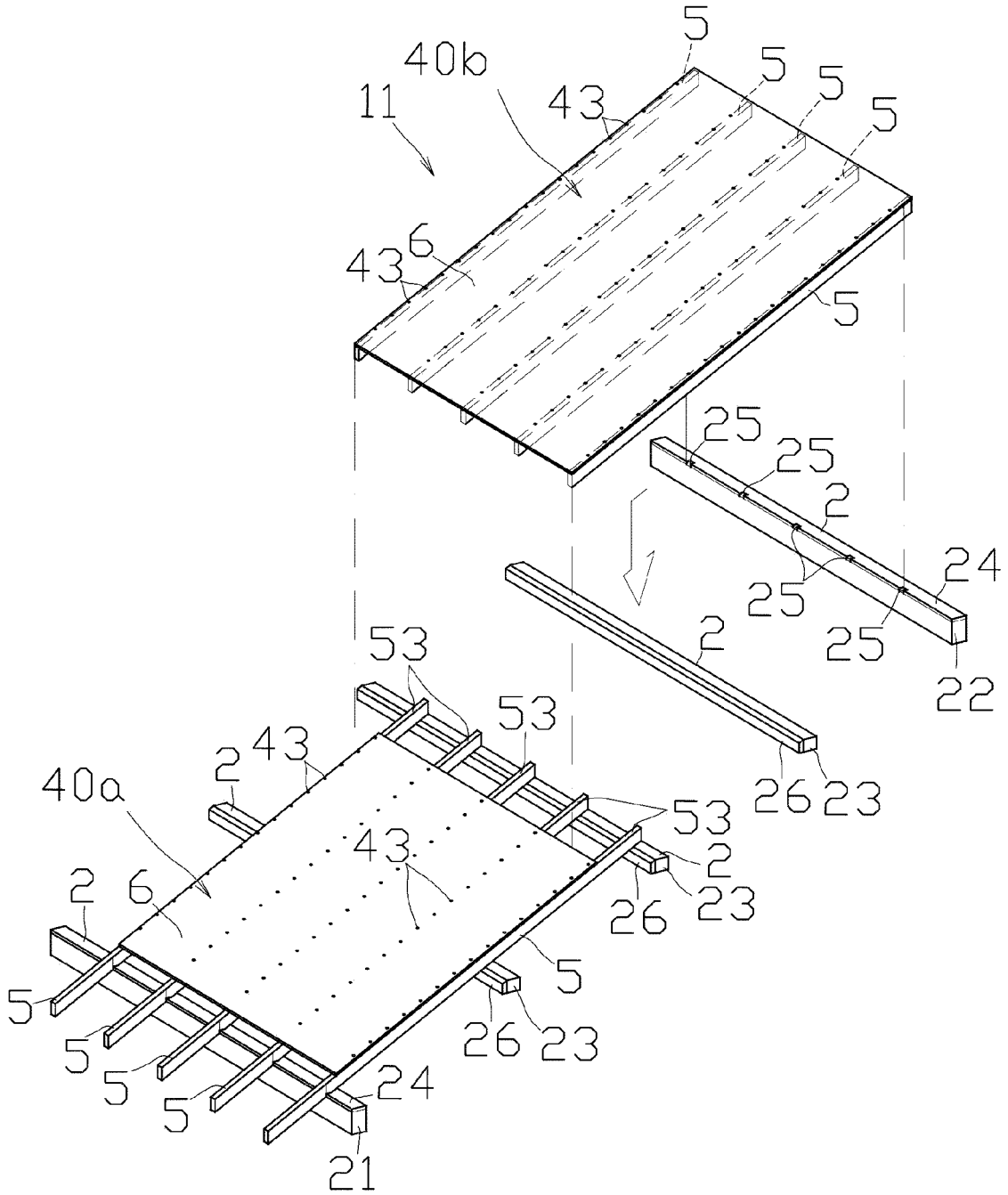

[FIG. 11]
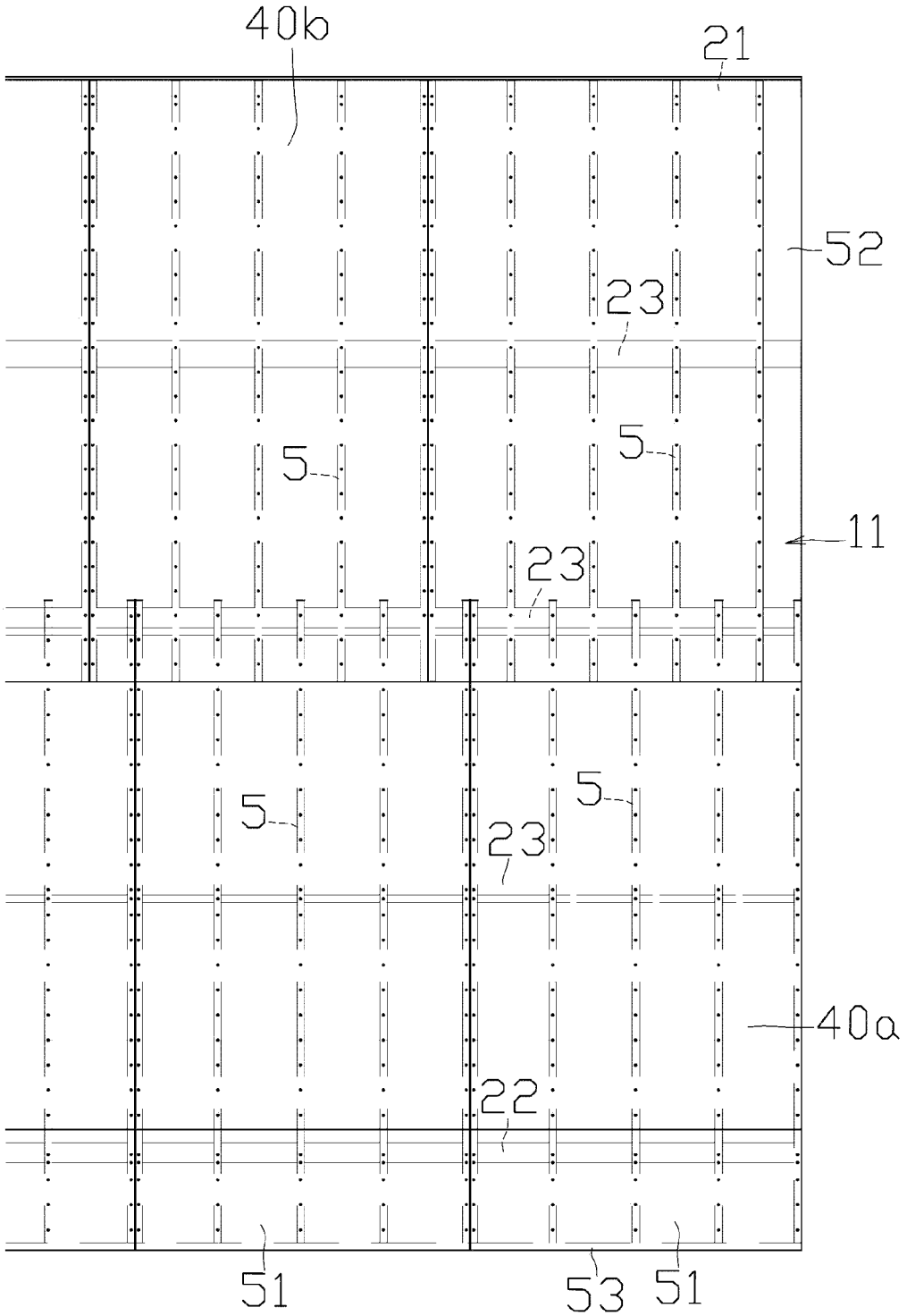

[FIG. 12]
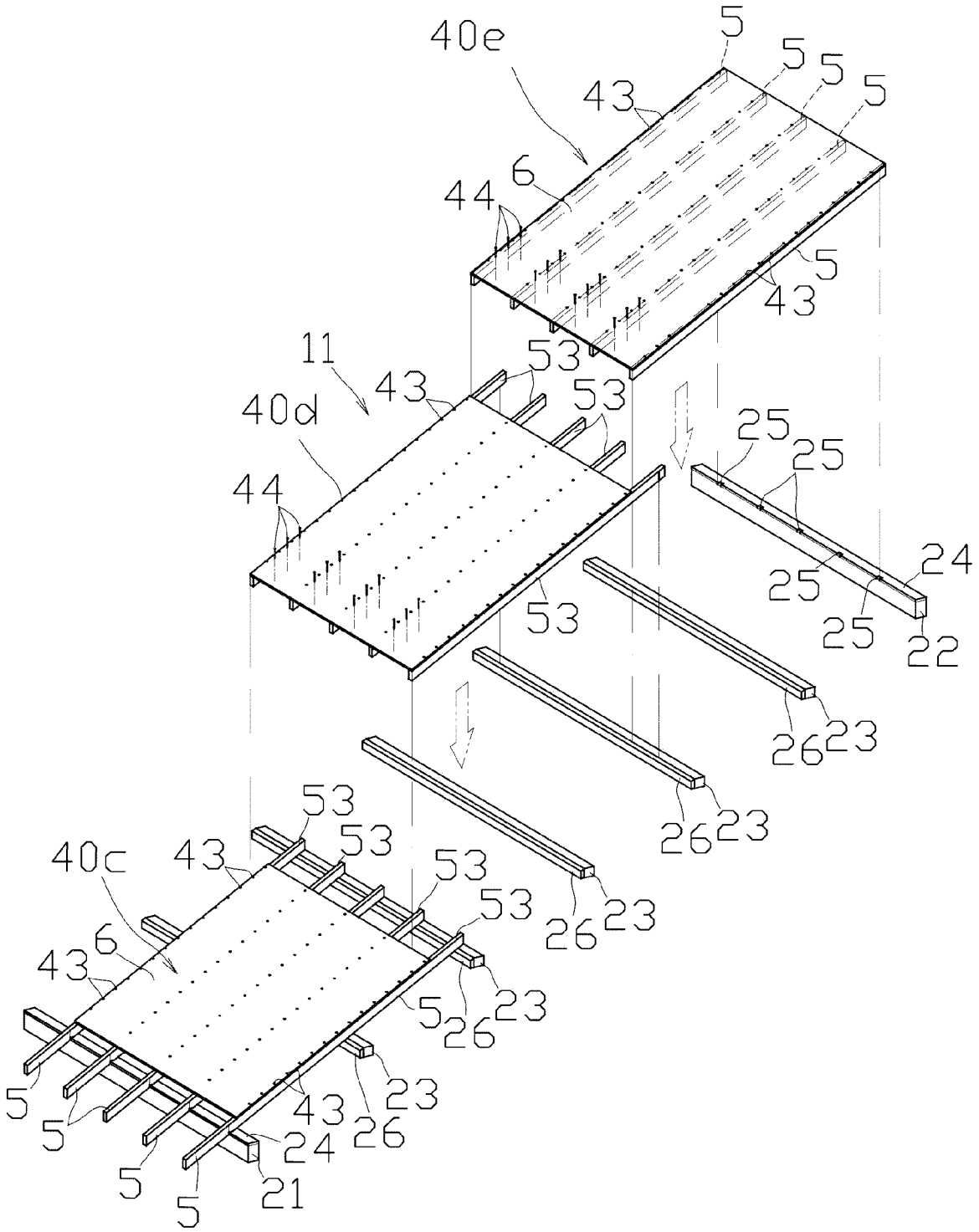

[FIG. 13]
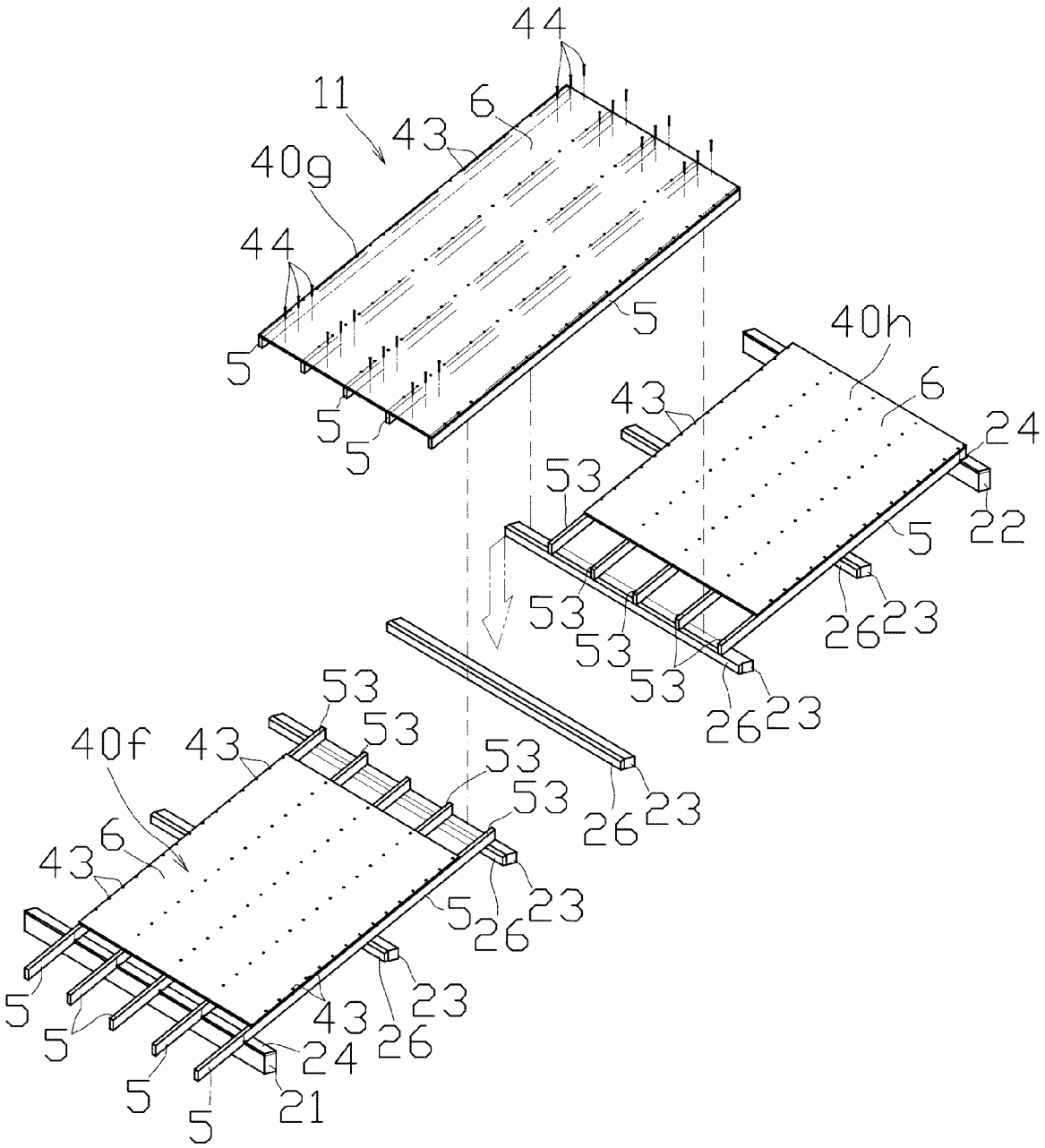

[FIG. 14]
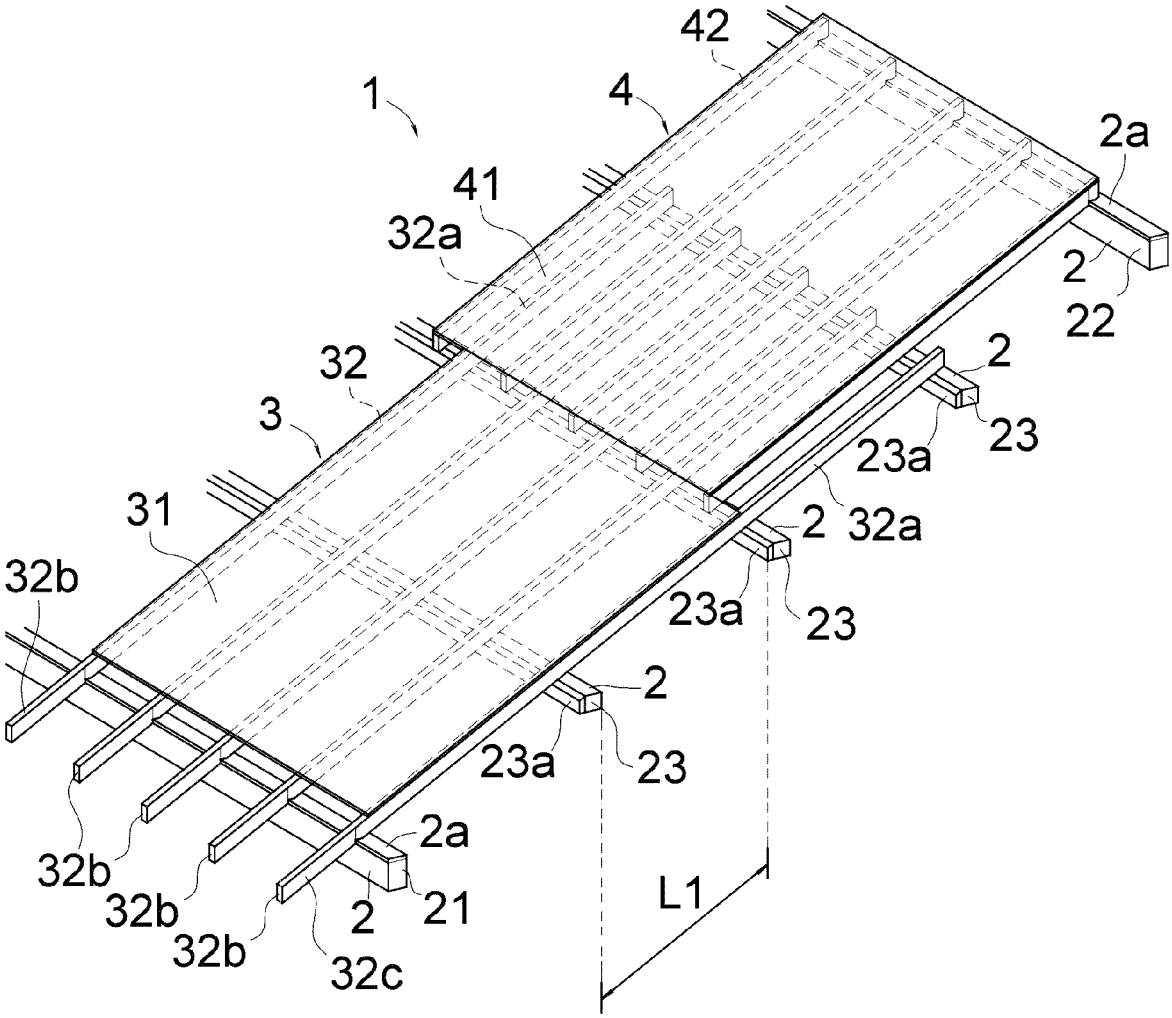

[FIG. 15]
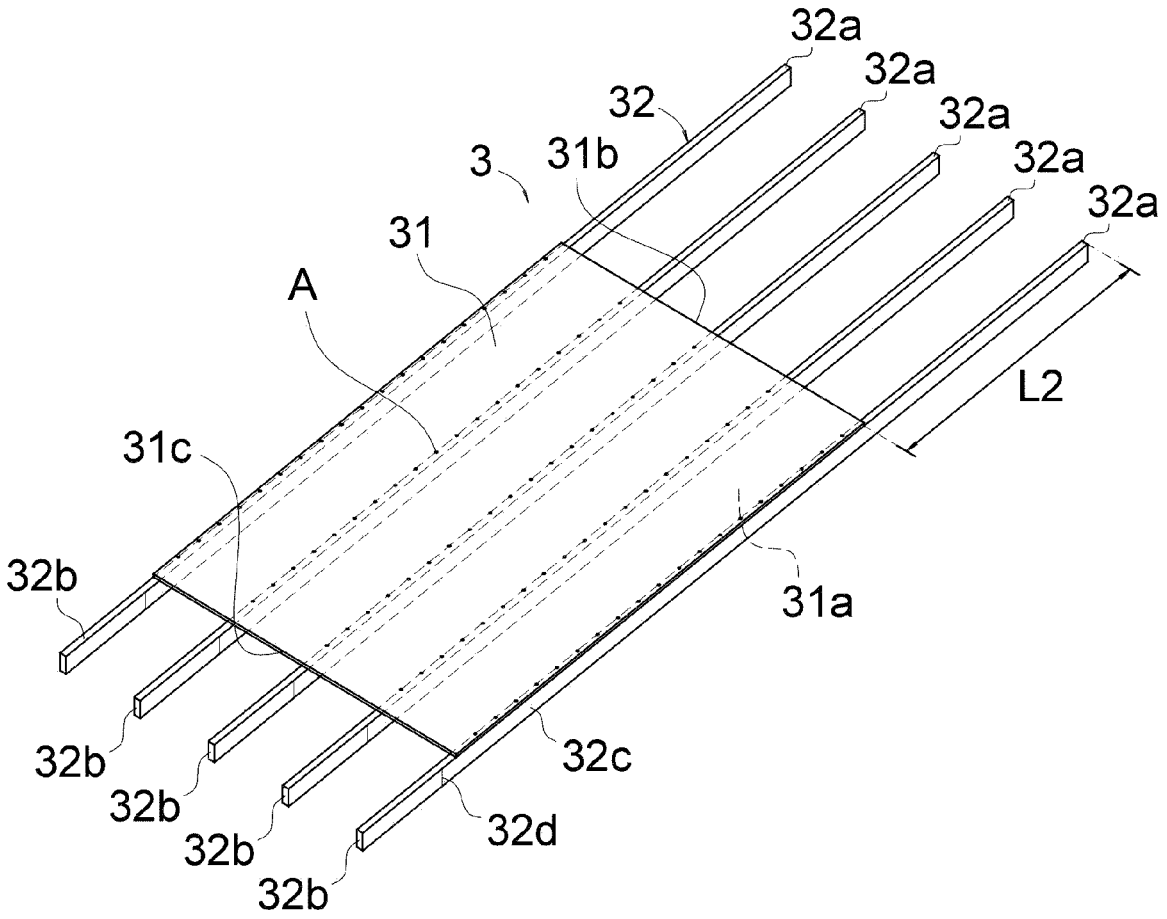

[FIG. 16]
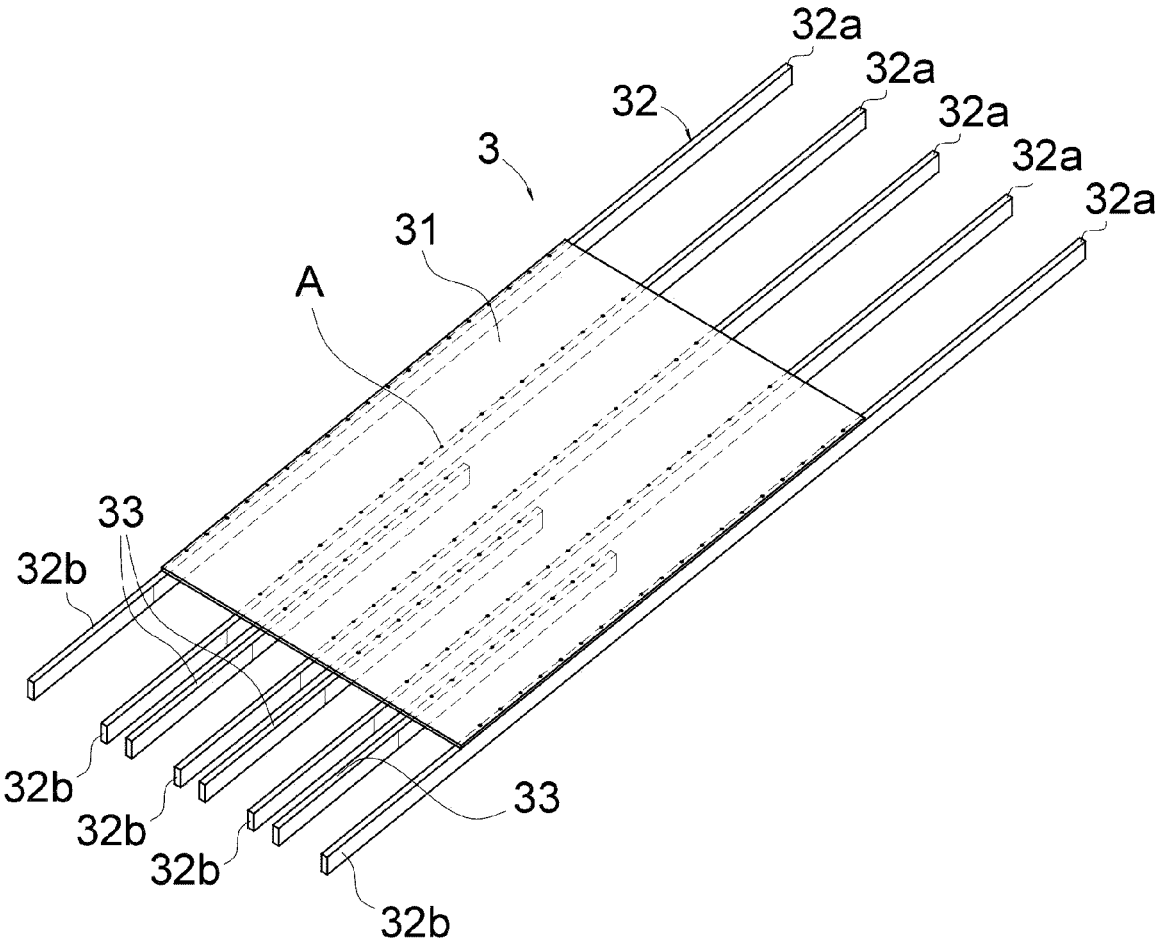

[FIG. 17]
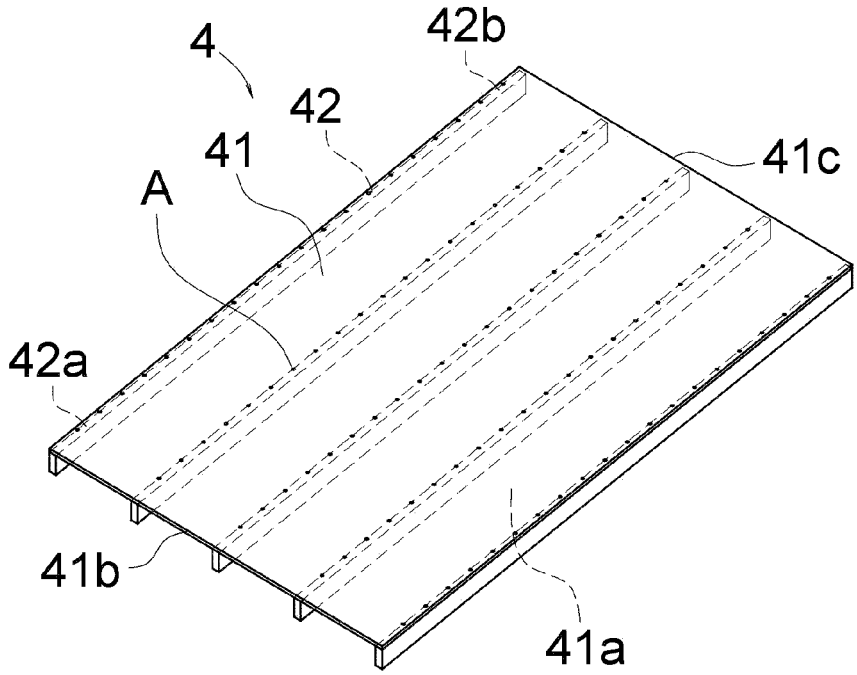

[FIG. 18]
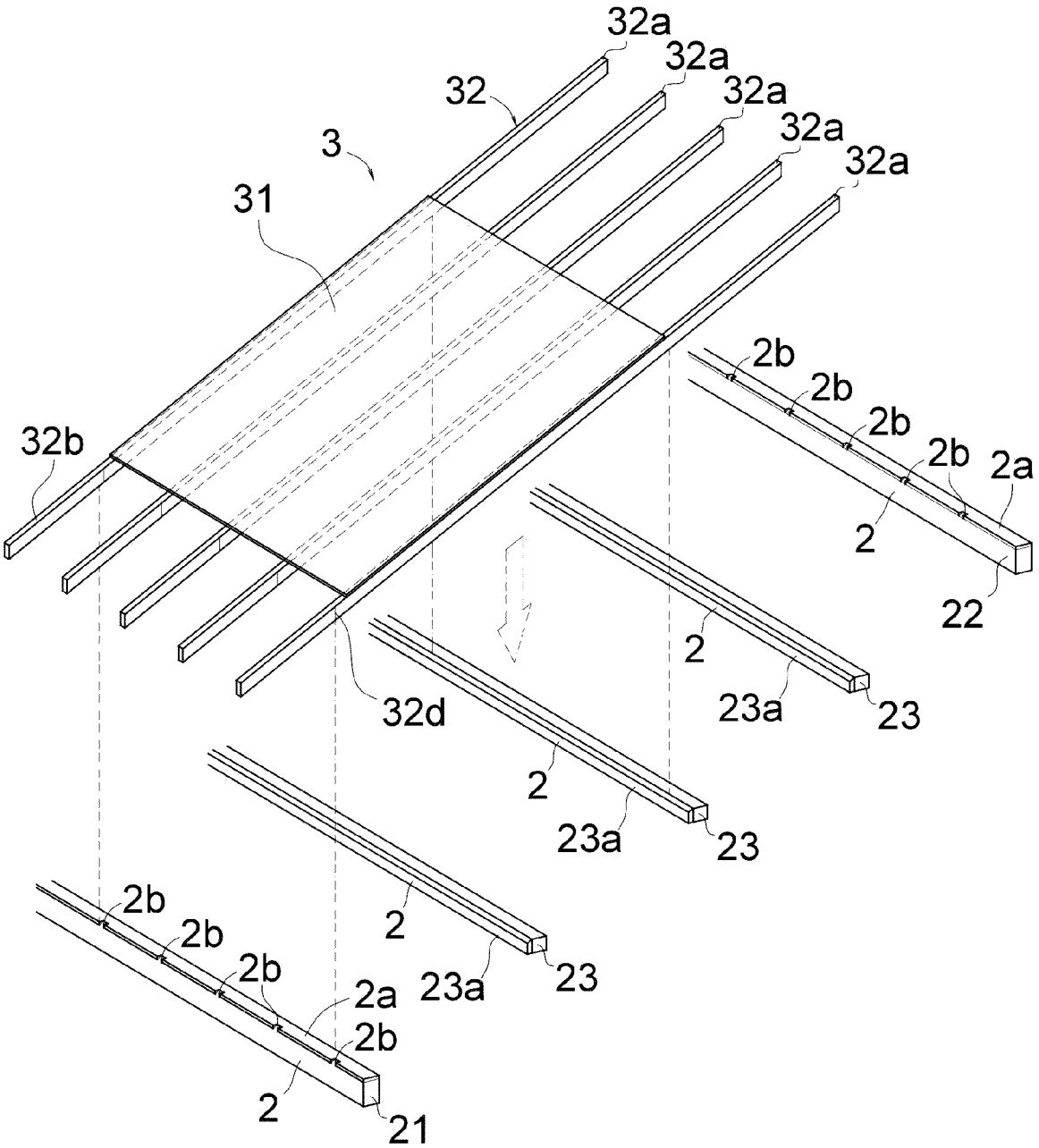

[FIG. 19]
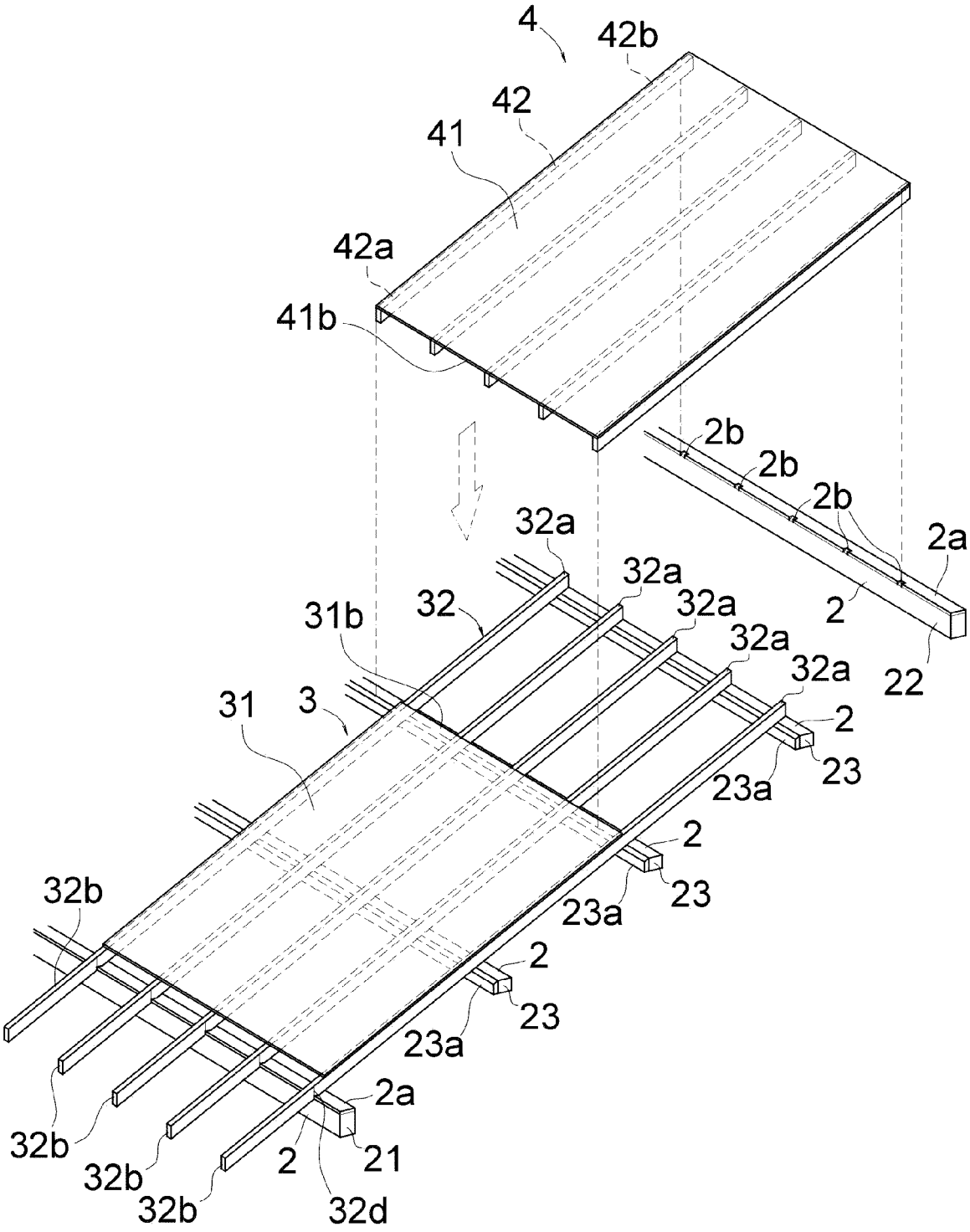

[FIG. 20]
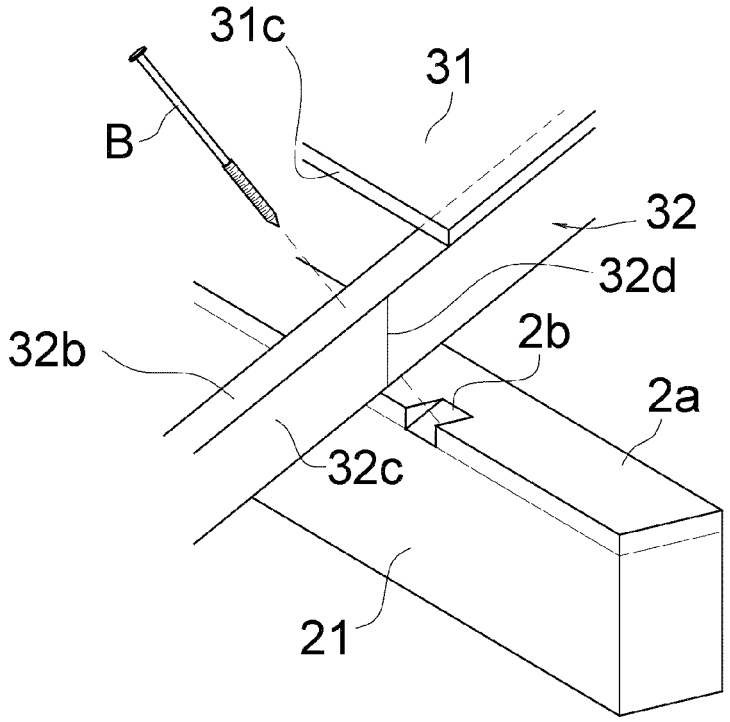
[FIG. 21]
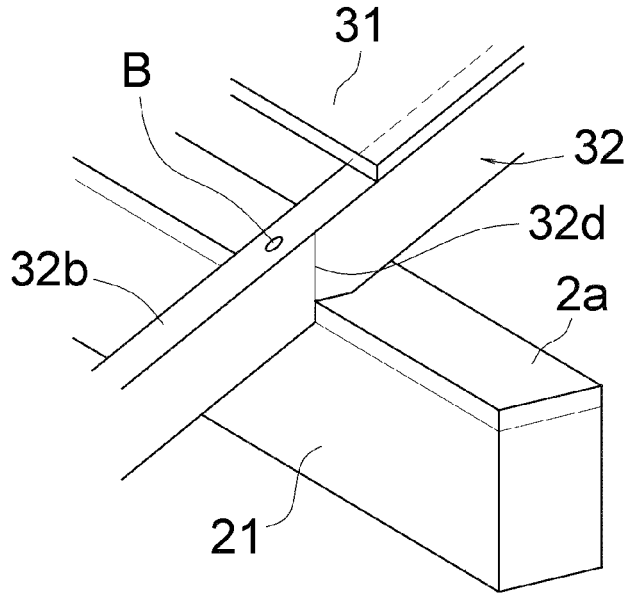

[FIG. 22]
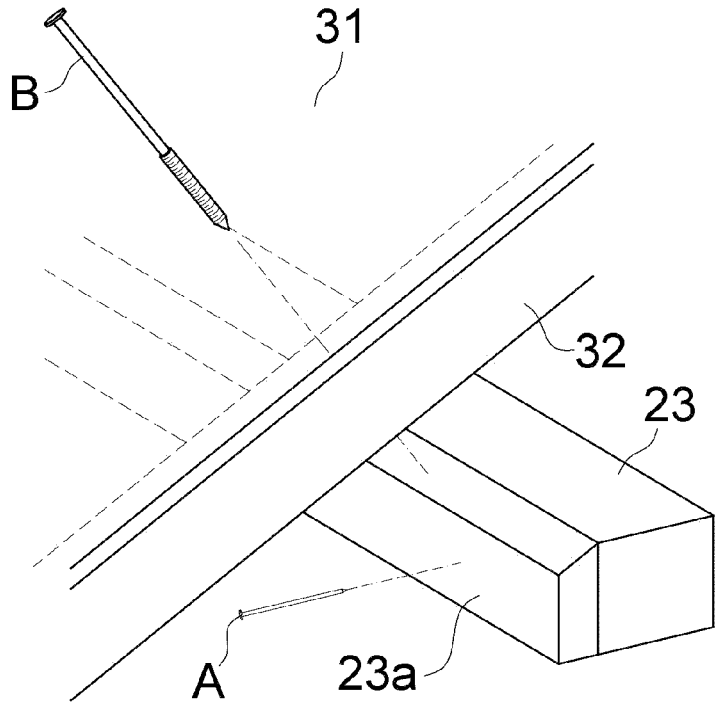

[FIG. 23]
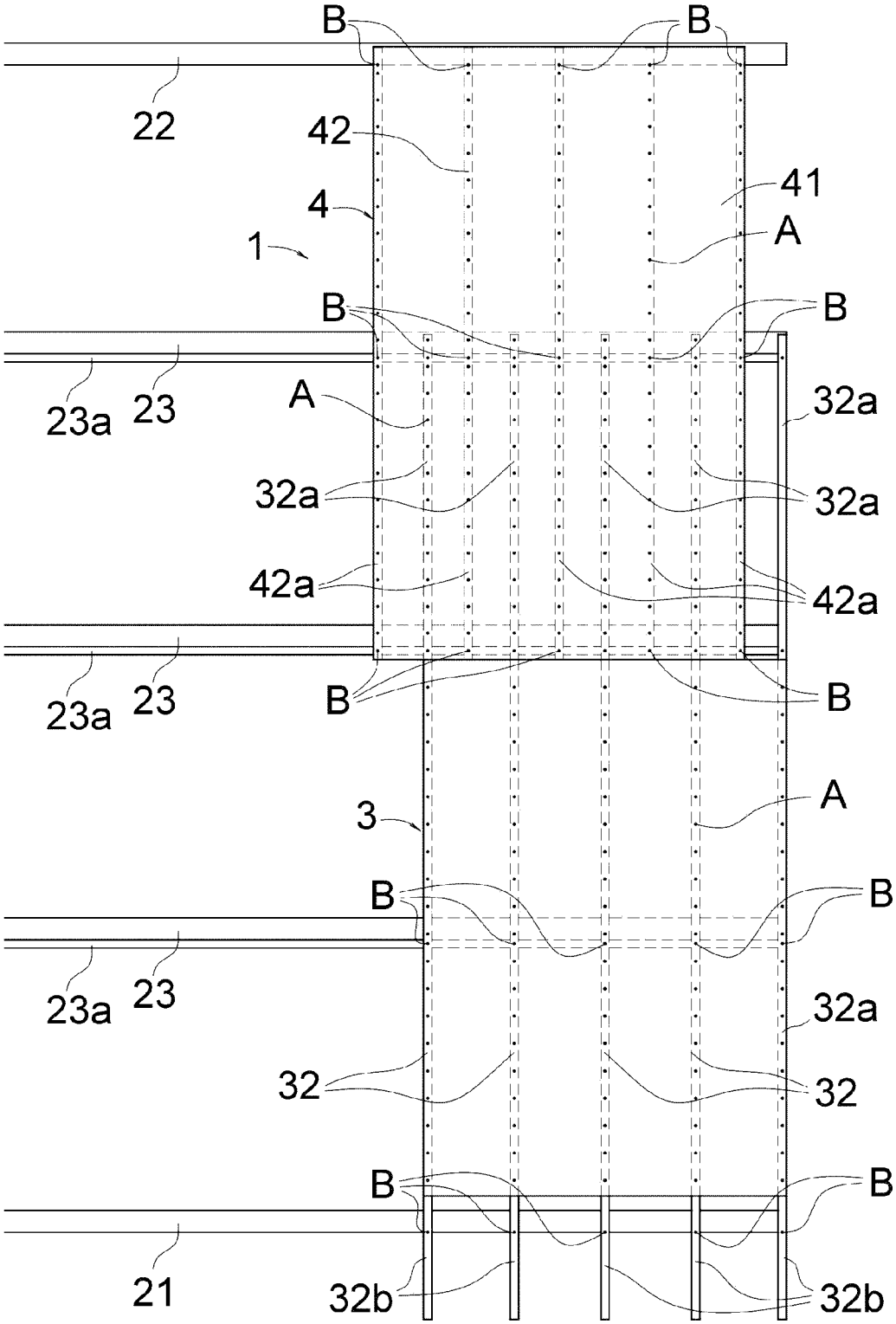

[FIG. 24]
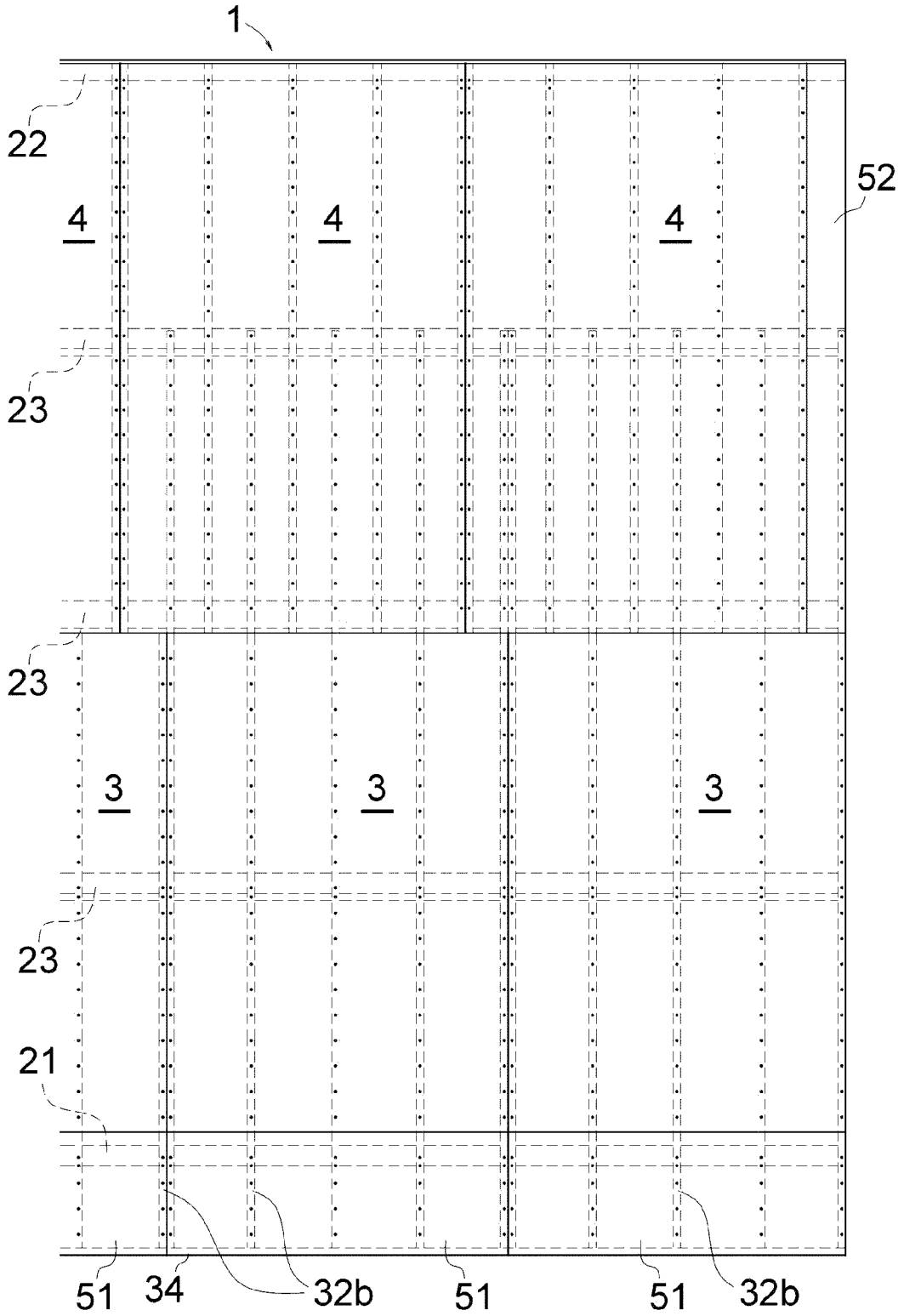

[FIG. 25]
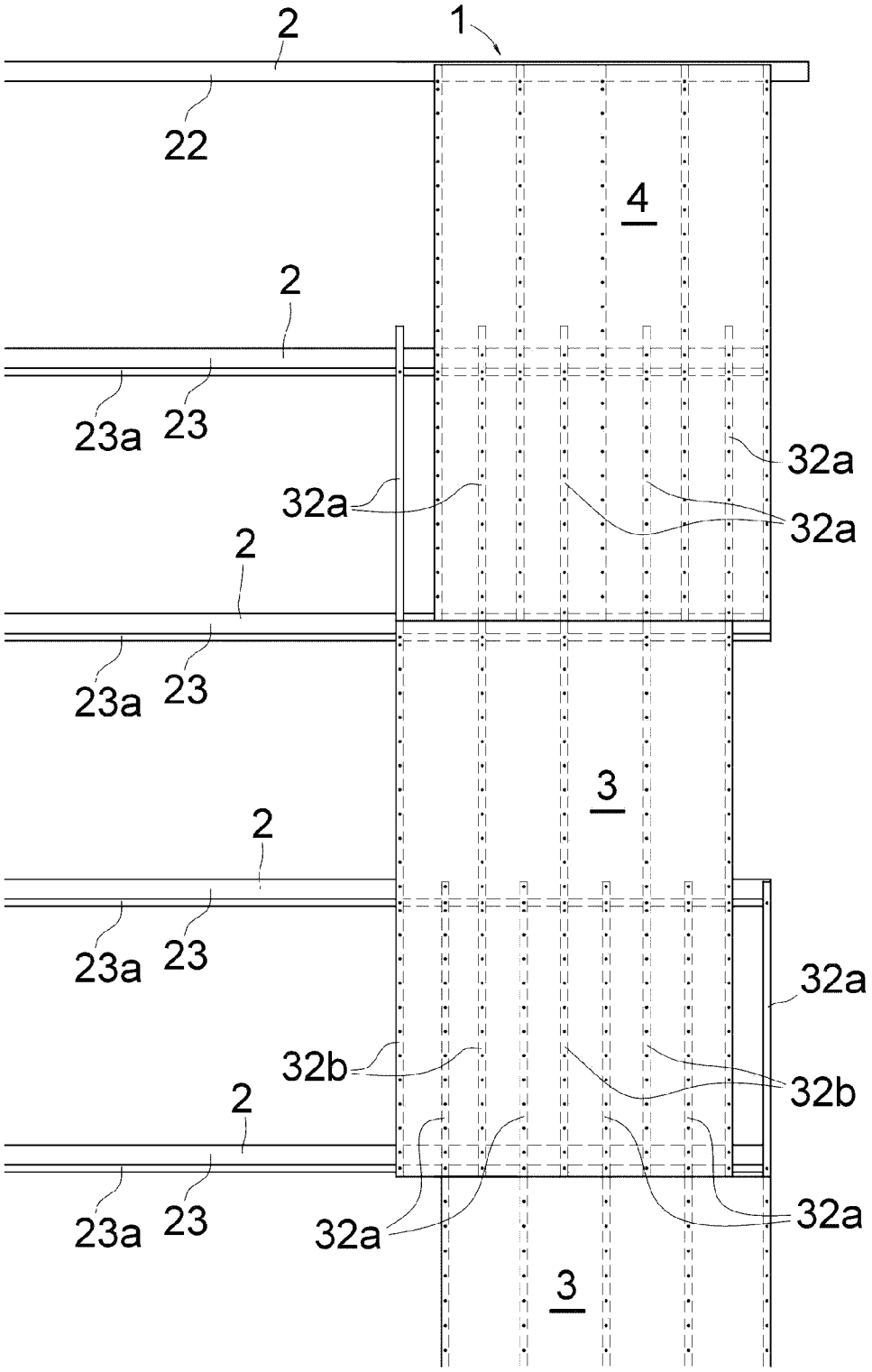

[FIG. 26]
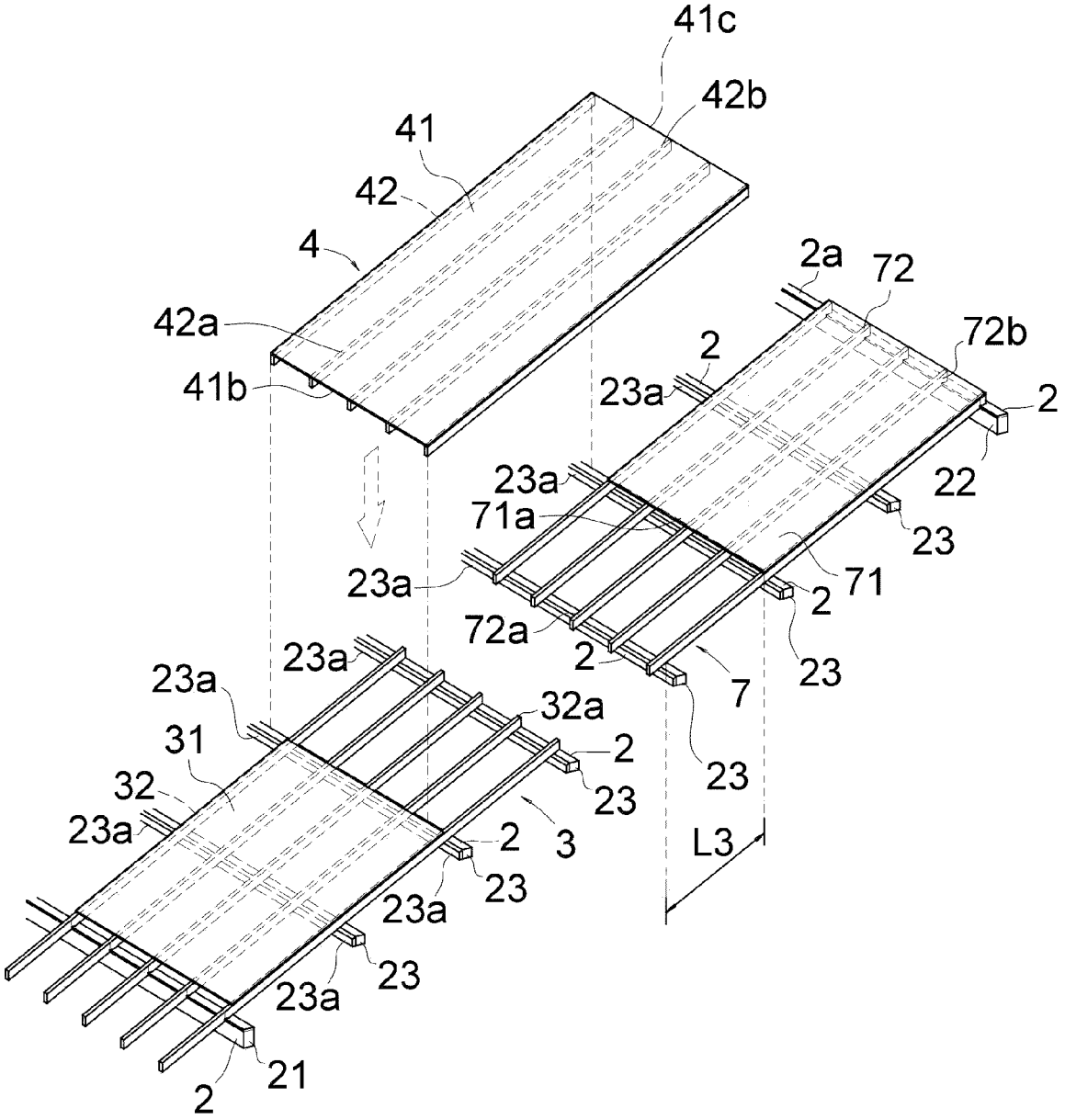

[FIG. 27]
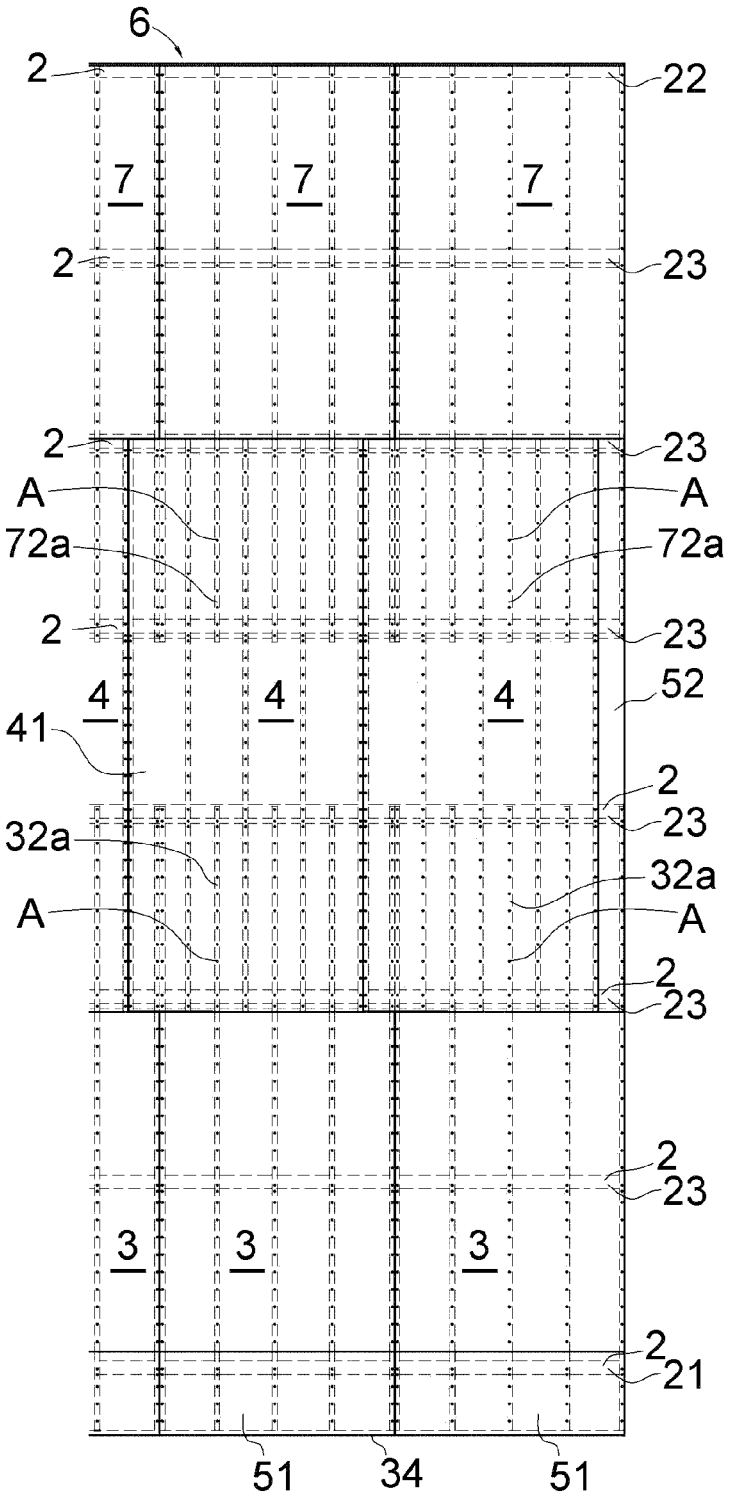

ROOF PANEL, ROOF STRUCTURE, AND ROOF STRUCTURE CONSTRUCTION METHOD

TECHNICAL FIELD

The present invention relates to a roof panel which forms a roof slope, a roof structure constituted by a roof panel which forms a roof slope, and a construction method of these.

BACKGROUND ART

Conventionally, some of sloping roofs are formed using roof panels each of which includes a plate material functioning as a base material for a roof finishing material and fixed to rafters spanned between horizontal base materials such as purlins (for example, Patent Literature 1 and Patent Literature 2). These roof panels are carried into a construction site in a state where the rafters and the plate materials placed and fixed on the rafters are integrated in advance in a factory. Accordingly, the respective members need not be lifted to a height of a roof and separately constructed, which improves workability.

CITATION LIST

Patent Literature

Patent Literature 1: JP 10-46737 A
Patent Literature 2: JP 7-286394 A

SUMMARY OF THE INVENTION

Technical Problems

Meanwhile, bearing force (horizontal bearing force) of entire roof structural surfaces of some wooden roof structures is secured by combining joining strength between purlins and rafters and joining strength between the rafters and a roofing board. However, according to roof panels described in Patent Literatures 1 and 2, adjacent roof panels are disposed on horizontal base materials in a state of alignment between joining portions of the respective roof panels in both horizontal and roof slope directions. In this case, joint positions of the roof panels weaken the structure, and reinforcements such as horizontal braces are highly likely to be required to secure sufficient horizontal strength of the entire roof. Alternatively, the joint positions of the roof panels may be disposed in a staggered manner. However, this arrangement complicates allocation of the roof panels and causes a problem of more complicated processes for construction.

On the other hand, for forming a large sloped roof having a large length, such as a roof having a large length between beams and a one-sided roof, wooden rafters sloped along a roof slope may be joined to each other. In this case, highly accurate construction is required by the necessity of accurate joining between joint portions of the rafters to form a smooth roof surface. It is extremely difficult, however, to accurately join the sloped long rafters with sufficient accuracy, and the construction accuracy depends largely on skills of builders. In this case, construction quality may differ depending on a construction site.

Accordingly, the present invention has been developed in consideration of the aforementioned problems. An object of the present invention is to provide a roof panel easily constructed while maintaining structural strength required for a roof, a structure using the roof panel, and a construction method of these.

Solutions to the Problems

A first roof structure according to the present invention is a roof structure comprising a plurality of horizontal base materials disposed in parallel to each other with a clearance left between each other, and so disposed as to produce a height difference that forms a roof slope, and a plurality of roof panels fixed on the horizontal base materials and spread side by side in a slope direction, wherein each of the roof panels includes a roofing board, and rafters fixed to a lower surface of the roofing board in parallel to each other with a clearance left between each other, and extending perpendicularly to the horizontal base materials, each of the rafters of one of the two adjacent roof panels in the slope direction includes a carry-out portion that projects from an edge of the roofing board, each of the carry-out portions is disposed between the rafters of the other roof panel and fixed to the roofing board of the other roof panel, a projection length of the carry-out portions is smaller than a distance between the adjoining horizontal base materials, and the carry-out portions and the other roof panel are fixed to the same horizontal base material.

In a second roof structure according to the present invention, the one roof panel is fixed to the horizontal base materials with the carry-out portions facing an upstream side, and the other roof panel is disposed on the upstream side of the one roof panel and fixed to the horizontal base materials.

In a third roof structure according to the present invention, the carry-out portions of the one roof panel and the rafters of the other roof panel are alternately disposed at equal intervals.

A fourth roof structure according to the present invention is the roof structure includes the three or more roof panels disposed side by side in the slope direction, wherein each of the roof panels located on a downstream side except for the roof panel located closest to a ridge side includes the carry-out portions that project toward the upstream side, and each of the carry-out portions is disposed and fixed between the rafters of the roof panel adjacent on the upstream side.

A fifth roof structure according to the present invention is the roof structure includes the three or more roof panels disposed side by side in the slope direction, wherein the roof panel on the upstream side includes the carry-out portions that project toward the downstream side, the roof panel on the downstream side includes the carry-out portions that project toward the upstream side, and the roof panel that is an intermediate roof panel located between the roof panel on the upstream side and the roof panel on the downstream side is disposed such that an upstream end and a downstream end of each of the rafters do not project from an edge of the roofing board.

A roof structure construction method according to the present invention is a roof structure construction method for constructing the roof structure according to any one of 1 to 5 comprising fixing the one roof panel to the horizontal base materials, and then disposing the other roof panel such that the roofing board of the other roof panel covers the carry-out portions of the one roof panel, and bringing ends of the roofing boards of the one roof panel and the other roof panel into abutment with each other; and driving a fixing tool into each of the carry-out portions from above the roofing board of the other roof panel to fix the one roof panel and the other roof panel.

A first roof panel according to the present invention is a roof panel comprising a first roofing board, and a plurality of first rafters fixed to a lower surface of the first roofing board in parallel to each other with a clearance left between each other, and projecting from at least one edge of the first roofing board, the roof panel being fixed to upper parts of a plurality of horizontal base materials disposed in parallel to each other with a clearance left between each other, wherein a projection length of a first projection portion included in each of the first rafters and projecting from an edge of the first roofing board is equal to or larger than an interval between the adjoining horizontal base materials.

A sixth roof structure according to the present invention comprises a plurality of horizontal base materials disposed in parallel to each other with a clearance left between each other and extending in an outrigger direction and the first roof panel, wherein the roof panel is fixed to the horizontal base materials with the first projection portions facing an upstream side.

A seventh roof structure according to the present invention comprises a receiving roof panel that includes a second roofing board disposed with one edge of the second roofing board abutting on one edge of the first roofing board and a plurality of second rafters fixed to a lower surface of the second roofing board in parallel to each other with a clearance left between each other, and disposed such that at least one end of each of the second rafters is disposed at one edge of the second roofing board, wherein the receiving roof panel is fixed to the horizontal base materials with one end of each of the second rafters disposed between the adjacent first projection portions.

An eighth roof structure according to the present invention comprises a second roof panel that includes a third roofing board disposed with one edge of the third roofing board abutting on the opposite edge of the second roofing board, and a plurality of third rafters fixed to a lower surface of the third roofing board in parallel to each other with a clearance left between each other, and disposed such that one end of each of the third rafters projects from one edge of the third roofing board, wherein the second roof panel is fixed to the horizontal base material located on a most upstream side in a state where a second projection portion included in each of the third rafters and projecting from an edge of the third roofing board faces a downstream side, and the receiving roof panel is fixed to the horizontal base materials in a state where the opposite end of each of the second rafters are disposed between the adjacent second projection portions.

A second roof structure construction method according to the present invention is the roof structure construction method using the roof structure according to any one of 6 to 8 comprising fixing the roof panel to the horizontal base materials with the first projection portion of each of the first rafters facing the upstream side, bringing one edge of the second roofing board into abutment with one edge of the first roofing board from above, and fixing the receiving roof panel to the horizontal base materials with one end of each of the second rafters disposed between the first projection portions, and fixing the second roofing board to the first projection portions.

A third roof structure construction method according to the present invention is the roof structure construction method comprising bringing one and the other edges of the second roofing board into abutment with the one edge of the first roofing board and the one edge of the third roofing board from above, respectively, after the second roof panel is fixed to the horizontal base materials located on the most upstream side with the second projection portion of each of the third rafters facing the downstream side, fixing the receiving roof panel to the horizontal base materials with one end of each of the second rafters disposed between the first projection portions and with the opposite end of each of the second rafters disposed between the second projection portions, and fixing the second roofing board to the first projection portions and the second projection portions.

Advantageous Effects of Invention

According to the first roof structure of the present invention, one of the two roof panels adjacent to each other in the slope direction includes the carry-out portions which are the rafters projecting from the edge of the roofing board. Each of the carry-out portions is disposed between the rafters of the other roof panel and fixed to the roofing board of the other roof panel. Accordingly, the roof panels are joined to each other by joining the rafters of the one roof panel and the roofing board of the other roof panel. As described above, the carry-out portion of each of the rafters projecting from the one roof panel is disposed between the rafters of the other roof panel. In this manner, an interval between the rafters at the joint positions between the roof panels decrease. Therefore, workability improves without the necessity of joining ends of the rafters of the respective panels as conventionally required. In addition, structural strength produced by the rafters increases. Moreover, the joining portions of the roofing boards and the joining portions of the rafters are not aligned with each other in each of the panels. This configuration can supplement structural weaknesses. In addition, required horizontal strength as the whole roof structural surface can be secured by maintaining the joining strength between the rafters and the roofing board. Furthermore, the projection length of the carry-out portions is smaller than the length of the adjacent horizontal base materials, and the carry-out portions and the other roof panel are fixed to the same horizontal base material. Accordingly, the roof panels can be easily handled while minimizing the projection length of the carry-out portions without lowering the joining strength between the respective roof panels.

According to the second roof structure of the present invention, the one roof panel is fixed to the horizontal base materials with the carry-out portions facing the upstream side. The other roof panel is disposed on the upstream side with respect to the one roof panel, and fixed to the horizontal base materials. In this case, during construction, the one roof panel disposed on the downstream side is initially fixed onto the horizontal base materials, and then the other roof panel on the upstream side is fixed onto the horizontal base materials. Accordingly, work is performable while facing the upstream side, which improves workability.

According to the third roof structure of the present invention, the carry-out portions of the one roof panel and the rafters of the other roof panel are alternately disposed at equal intervals. Accordingly, joining strength between the roof panels can be equalized.

According to the fourth roof structure of the present invention, the roof structure includes the three or more roof panels disposed side by side in the slope direction. In addition, each of the roof panels on the downstream side except for the roof panel closest to the ridge side has the carry-out portions each projecting toward the upstream side, and the carry-out portions are arranged and fixed between the rafters of the roof panel adjacent on the upstream side. Accordingly, an increase in the roof size can be handled by arranging the plurality of roof panels in the slope direction.

According to the fifth roof structure of the present invention, the roof structure includes the three or more roof panels disposed side by side in the slope direction. The roof panel on the upstream side includes the carry-out portion that projects toward the downstream side. The roof panel on the downstream side includes the carry-out portion that projects toward the upstream side. The roof panel that is an intermediate roof panel located between the roof panel on the upstream side and the roof panel on the downstream side, and is configured such that an upstream side end and a downstream side end of each of the rafters do not project from an edge of the roofing board. In this manner, a large roof can be formed by arranging a plurality of the roof panels in the slope direction.

According to the roof structure construction method of the present invention, the one roof panel is fixed to the horizontal base materials, and then the other roof panel is disposed such that the roofing board of the other roof panel covers the carry-out portions of the one roof panel. The ends of the roofing boards of the one roof panel and the other roof panel are brought into abutment with each other. The fixing tools are driven into the carry-out portions from above the roofing board of the other roof panel to fix the one roof panel and the other roof panel to each other. In this manner, the respective roof panels are easily joined to each other, which improves workability.

According to the first roof panel of the present invention, the one end of each of the first rafters projects from the edge of the first roofing board to form the first projection portion. Accordingly, an interval between the rafters of the respective panels can be reduced by setting the roof panel on the horizontal base materials with the first protrusion portions facing in the roof slope direction, and bringing a roofing board of a composite panel which includes a roofing board widely spread and rafters integrated with each other into abutment with one edge of the first roofing board, and by fixing the composite panel to the horizontal base materials with the rafters of the composite panel disposed between the adjacent first rafters. Therefore, workability improves without the necessity of j oining ends of the rafters of the respective panels as conventionally required. In addition, structural strength of the joining portions of the rafters increases. In addition, the joining portions of the roofing boards of the respective panels and the joining portions of the rafters are not aligned with each other. Accordingly, structural strength required for the roof can be maintained by supplementing structural weaknesses. Furthermore, the projection length of the first projection portions is equal to or greater than the interval between the adjacent horizontal base materials. Accordingly, the roof panel can be stably set on the upper parts of the horizontal base materials.

According to the sixth roof structure of the present invention, the roof panel is fixed to the roof horizontal base materials with the first projection portions facing the upstream side. Accordingly, an interval between the rafters of the respective panels can be reduced by bringing a roofing board of a composite panel which includes a roofing board widely spread and rafters integrated with each other into abutment with one edge of the first roofing board from the upstream side, and fixing the composite panel to the horizontal base materials with the rafters of the composite panel disposed between the adjacent first rafters. Therefore, workability improves without the necessity of j oining ends of the rafters of the respective panels as conventionally required. In addition, structural strength of the joining portions of the rafters increases. Moreover, the joining portions of the roofing boards and the joining portions of the rafters are not aligned with each other in each of the panels. This configuration can supplement structural weaknesses. In addition, required horizontal strength as the whole roof structural surface can be secured by maintaining the joining strength between the rafters and the roofing board.

According to the seventh roof structure of the present invention, the one edge of the second roofing board is disposed in abutment with the one edge of the first roofing board, and the receiving roof panel is fixed to the horizontal base materials with the one end of the second rafter disposed between the adjacent first projection portions. In this case, the interval between the one end of the second rafter and the first projection portion can be reduced. Therefore, workability improves without the necessity of joining ends of the rafters of the respective panels as conventionally required. In addition, structural strength of the joining portions of the rafters increases. Moreover, the joining portions of the roofing boards and the joining portions of the rafters are not aligned with each other in each of the panels. This configuration can supplement structural weaknesses. In addition, required horizontal strength as the whole roof structural surface can be secured by maintaining the joining strength between the rafters and the roofing board.

According to the eighth roof structure of the present invention, the one edge of the third roofing board is disposed in abutment with the opposite edge of the second roofing board, and the receiving roof panel is fixed to the horizontal base materials with the opposite end of the second rafter disposed between the adjacent second projection portions. Accordingly, even in a case of a large roof, the necessity of joining the ends of the respective rafters at a construction site is eliminated by combining the respective roof panels, which improves workability.

According to the second roof structure construction method of the present invention, the one end of each of the second rafters is disposed between the adjacent first projection portions exposed from the first roofing board after the roof panel is set on the horizontal base materials. Accordingly, the necessity of joining the ends of the first rafters and the second rafters at a construction site is eliminated, which improves workability.

According to the third roof structure construction method of the present invention, the roof structure can be constructed only by dropping the receiving roof panel between the roof panel and the second roof panel from above after the second roof panel is fixed to the horizontal base materials on the most upstream side for positioning of the upstream side. Accordingly, workability improves. In addition, both the ends of the second rafter are disposed between the first projection portions and between the second projection portions, respectively, which are projection portions exposed from the first and third roofing boards. Accordingly, the necessity of joining the ends of the respective rafters at a construction site is eliminated, which improves workability.

BRIEF DESCRIPTION OF THE DRAWINGS

FIG. 1 is a perspective view showing a whole structure of a roof structure according to a first embodiment.

FIG. 2 is a perspective view showing a structure of the one roof panel.

FIG. 3 is a perspective view showing a structure of the other roof panel.

FIG. 4 is a view illustrating a state that the one roof panel is fixed to the horizontal base materials according to a construction method of the roof structure.

FIG. 5 is a view showing a state before the rafters of the one roof panel are fixed to an outrigger.

FIG. 6 is a view showing a state after the rafters of the one roof panel were fixed to the outrigger.

FIG. 7 is a view showing a state that the rafters of the roof panel are fixed to the purlins.

FIG. 8 is a view showing a state that the joining fixing tools are driven between the carry-out portions of the one roof panel by disposing the rafters of the other roof panel.

FIG. 9 is a view illustrating a state that the one rafter joining tools are driven into the purlins by penetrating the roofing board and the rafters.

FIG. 10 is a view illustrating a state that the other roof panel is fixed to the horizontal base materials according to a roof structure construction method.

FIG. 11 is a view illustrating a state that a roof structure was completed according to a first embodiment.

FIG. 12 is an exploded view illustrating a whole structure of a roof structure according to a second embodiment.

FIG. 13 is an exploded view illustrating a whole structure of a roof structure according to a third embodiment.

FIG. 14 is a perspective view showing a roof structure according to a forth embodiment.

FIG. 15 is a perspective view showing a roof panel according to a forth embodiment.

FIG. 16 is a perspective view showing a roof panel comprising the reinforcing rafters according to a forth embodiment.

FIG. 17 is a perspective view showing a receiving roof panel according to a forth embodiment.

FIG. 18 is a perspective view showing a condition that a roof panel is spanned on the horizontal base materials according to a forth embodiment.

FIG. 19 is a perspective view showing a condition that a receiving roof panel is spanned on the horizontal base materials according to a forth embodiment.

FIG. 20 is a perspective view showing a state before the first rafters are fixed to the outrigger according to a forth embodiment.

FIG. 21 is a perspective view showing a state that the first rafters were fixed to the outrigger according to a forth embodiment.

FIG. 22 is a perspective view showing a state that the second rafters are set on the purlins according to a forth embodiment.

FIG. 23 is a plan view showing a roof structure according to a forth embodiment.

FIG. 24 is a plan view showing a condition that a plurality of the roof panels and the receiving roof panels were spanned on the horizontal base materials to a forth embodiment.

FIG. 25 is a plan view showing a roof structure comprising a plurality of the roof panels according to a modification of a forth embodiment.

FIG. 26 is a perspective view showing a condition that a receiving roof panel is set between a roof panel and a second roof panel according to a fifth embodiment.

FIG. 27 is a plan view showing a roof panel according to a fifth embodiment.

DESCRIPTION OF EMBODIMENTS

First Embodiment

A roof structure according to a first embodiment of the present invention will be hereinafter described with reference to the respective drawings. For example, a roof structure 11 of the present embodiment is a roof structure 11 having a slope, such as a gable roof, a one-sided roof, and a hipped roof. For example, the roof structure 11 is a type supported by a roof frame of a wooden structure, but may be a type partially or entirely supported by a steel roof frame. As shown in FIG. 1, the roof structure 11 includes a plurality of horizontal base materials 2 parallel to each other with a clearance left between each other, and perpendicular to a slope direction, and a plurality of roof panels 40 fixed onto the horizontal base materials 2.

The horizontal base materials 2 are a plurality of long wooden materials. The horizontal base materials 2 are supported by not-shown pillars or posts, and extend in the horizontal direction. The plurality of horizontal base materials 2 are parallel to each other, and have such a height difference that the horizontal base materials 2 on an upstream side are located high, and that the horizontal base materials 2 on a downstream side are located low. The horizontal base materials 2 are disposed along a roof slope. According to the example shown in the figure, the horizontal base materials 2 are constituted by an outrigger 21 disposed on the most downstream side, a ridge 22 disposed on the most upstream side, and three purlins 23 disposed between and in parallel to the outrigger 21 and the ridge 22. The number of the respective horizontal base materials 2 and the intervals between the respective horizontal base materials 2 are calculated and determined by structural calculation in consideration of factors such as a roof shape, a climate of each region, and a load acting on the roof. For example, a horizontal distance between the adjacent purlins 23 of the horizontal base materials 2 may be set in a range from 1000 mm to 1500 mm. Note that the arrangement of the horizontal base materials 2 in FIG. 1 is presented by way of example. The type and shape of the horizontal base materials 2, and the number of the purlins 23 are not particularly limited.

As shown in FIGS. 1 and 5, the outrigger 21 and the ridge 22 are long wooden members each having a rectangular cross section. A rafter stand 24 for receiving the rafters 5 of the roof panel 40 described below is fixed to an upper surface of each of the outrigger 21 and the ridge 22. Each of the rafter stands 24 includes groove-shaped notches 25 formed at positions where the respective rafters 5 are fixed, and each configured such that a bottom surface has a slope equal to the roof slope. As shown in FIG. 6, a lower side of the rafter 5 is inserted into the notch 25, and the rafter 5 is fixed to the outrigger 21 or the ridge 22 in a state where a lower surface of the corresponding rafter 5 come into contact with a bottom surface of the notch 25. While FIGS. 5 and 6 each show a joining portion between the outrigger 21 and the rafter 5, a joining portion between the ridge 22 and the rafter 5 has a similar configuration as shown in FIGS. 4 and 10.

As shown in FIGS. 1 and 7, a rafter receiver 26 which has an upper surface sloped in accordance with the roof slope is fixed to a side surface of each of the purlins 23 on the downstream side by a nail 27. A lower surface of each of the rafters 5 of the roof panel 40 comes into contact with an upper surface of the rafter receiver 26 to stabilize a sloped state of each of the rafters 5 along the roof slope and fix the rafter 5 and the purlin 23.

The roof panel 40 is a composite panel formed beforehand in a factory by fixing roofing boards 6 made of plywood and the rafters 5 each constituted by a square timber using fixing tools 43 constituted by screws or nails. A plurality of the roof panels 40 are spread side by side in the slope direction to form the roof slope, and roofing materials such as not-shown asphalt roofing and roof tiles are laid on the roofing boards 6 of the roof panels 40. According to the first embodiment, two types of roof panels 40*a* and 40*b* are provided as the roof panels 40, and disposed such that the roof panels 40*a* and 40*b* abut on each other in the slope direction. The roof panels 40*a* as one type of the roof panels 40 are disposed on the downstream side, while the other roof panels 40*b* as the other type are disposed on the upstream side.

As shown in FIG. 2, the one roof panel 40*a* has the roofing board 6, and a plurality of the rafters 5 fixed to the lower surface of the roofing board 6 in parallel to each other with a clearance left between each other. The roofing board 6 is structural plywood having a thickness of 12 mm, and has a rectangular shape having a width of 2000 mm or smaller and a length of 3000 mm or larger and 4000 mm or smaller. The roof panel 40*a* in this size can be lifted by a crane and placed at a predetermined position without any problem during construction, and can be easily transported. The rafters 5 are fixed to the roofing board 6 by a plurality of the fixing tools 43 such as nails driven from above the roofing board 6. The one roof panel 40*a* has carry-out portions 53 which are projecting portions of the rafters 5 from an edge of the roofing board 6. A projection length L of the carry-out portions 53 in the first embodiment is 500 mm. The projection length L of the carry-out portions 53 is smaller than at least a distance between the adjacent purlins 23. In addition, the projection length L of the carry-out portions 53 is equal to or larger than a length sufficient for fixing the carry-out portions 53 to the roofing board 6 of the other roof panel 40*b* by driving joining fixing tools 44 such as nails. For example, each of the joining fixing tools 44 is a thick iron round nail having a length of 50 mm. The roof panels 40 are joined to each other with joining strength necessary or larger by driving the three joining fixing tools 44 from above the roofing board 6 of the other roof panel 40*b* into each of the carry-out portions 53 of the rafters 5. When the projection length of each of the carry-out portions 53 is 500 mm or more, the three joining fixing tools 44 can be driven from above the roofing board 6 to the carry-out portion 53 with an appropriate distance left between each other.

Efficient construction work is achievable with easy handling of the one roof panel 40*a* during construction by setting the projection length of the carry-out portions 53 to the minimum projection length L required for joining the roof panels 40 to each other as described above.

In addition, the one roof panel 40*a* has the rafters 5 projecting from a downstream edge of the roofing board 6. The projecting portion of the rafter 5 toward the downstream side is fixed to the outrigger 21. As shown in FIGS. 5 and 6, reference ink 54 is marked on a side surface of the rafter 5 at a position in contact with the outrigger 21 to equalize projections of eaves. A projection width of the rafters 5 of the roof panel 40*a* from the roofing board 6 is determined by a projection size of roof eaves. Note that each of the rafters 5 of the roof panels 40 other than the roof panel 40*a* provided on the most downstream side does not project from the roofing board 6 toward the downstream side.

Each of the rafters 5 of the one roof panel 40*a* has a length enough to be spanned over the outrigger 21 and the two purlins 23. The length of the rafters 5 of the one roof panel 40*a* is not limited to this length, but may be a length enough to be spanned over the three or more purlins 23.

An interval between the adjacent rafters 5 of the roof panel 40 is preferably 500 mm or smaller in accordance with positioning standards for the horizontal base materials 2 specified in "Allowable stress design of wooden frame construction method housing (2017 version)". In addition, the plurality of rafters 5 are preferably provided at equal intervals in consideration of allocation easiness and workability, but are not necessarily required to be provided at equal intervals as long the interval is 500 mm or smaller.

The other roof panel 40*b* included in the roof panels 40 and disposed on the upstream side is a composite panel which includes the roofing board 6 and the rafters 5 integrated beforehand in a factory, similarly to the one roof panel 40*a*. As shown in FIG. 3, the other roof panel 40*b* has the roofing board 6, and a plurality of the rafters 5 fixed to the lower surface of the roofing board 6 in parallel to each other with a clearance left between each other. Each of the rafters 5 is connected and fixed to the roofing board 6 by a plurality of the fixing tools 43 driven from above the roofing board 6. The rafters 5 of the other roof panel 40*b* are aligned with the edges of the roofing board 6 without projecting from both edges of the roofing board 6.

As shown in FIGS. 1 and 8, the roofing board 6 of the other roof panel 40*b* is disposed on the carry-out portions 53 of the one roof panel 40*a*, and covers the carry-out portions 53 from above. The carry-out portions 53 of the one roof panel 40*a* and the rafters 5 of the other roof panel 40*b* are arranged to overlap each other when viewed from the side. The carry-out portions 53 are disposed between the rafters 5 of the other roof panel 40*b*. The carry-out portions 53 of the one roof panel 40*a* and the rafters 5 of the other roof panel 40*b* are alternately disposed at equal intervals. In this manner, joining strength between the roof panels 40 is equalized to reduce an excessive load applied to a certain part when the carry-out portions 53 of the one roof panel 40*a* are fixed to the roofing board 6 of the other roof panel 40*b*.

The joining fixing tools 44 constituted by three nails are driven into each of the carry-out portions 53 of the one roof panel 40*a* at intervals of 150 mm from above the roofing board 6 of the other roof panel 40*b* to join the carry-out portions 53 of the one roof panel 40*a* and the roofing board 6 of the other roof panel 40*b*. Moreover, as shown in FIG. 9, one rafter joining tool 55 penetrates the roofing board 6 of the other roof panel 40*b* and the carry-out portion 53 of the one roof panel 40*a*, and is driven into the purlin 23 at a position where the carry-out portion 53 is disposed to join the carry-out portion 53 of the one roof panel 40*a* and the purlin 23. Joining strength between the carry-out portion 53 of one roof panel 40*a* and the roofing board 6 of the other roof panel 40*b* produced by the three joining fixing tools 44 is equal to or higher than joining strength between the carry-out portion 53 of the one roof panel 40*a* and the purlin 23 produced by the rafter joining tool 55.

According to this configuration, the one roof panel 40*a* and the other roof panel 40*b* can be integrated with each other as the whole roof panel 40 without joining the respective rafters 5, which increases structural strength.

As shown in FIG. 4, according to a construction method of the roof structure, the outrigger 21, the purlins 23, and the ridge 22 are spanned on the not-shown pillars or posts to constitute a roof frame. Thereafter, the one roof panel 40*a* is disposed and fixed to the outrigger 21 and the two purlins 23 adjacent to the outrigger 21. As described above, the one roof panel 40*a* is placed on the rafter stand 24 on the upper part of the outrigger 21 and the rafter receivers 26 fixed to the purlins 23 in a state where the carry-out portions 53 of the rafters 5 face the upstream side. Thereafter, as shown in FIG. 5, a downstream end of the rafter 5 is fitted into the notch of the rafter stand 24. Subsequently, after the reference ink 54 and a downstream corner of the rafter stand 24 are aligned to equalize the protrusion width of the downstream end from the outrigger 21, the rafter joining tool 55 as a long screw is driven from above to integrally connect and fix the downstream end of the rafter 5 and the outrigger 21 as shown in FIG. 6. At this time, the reference ink 54 is not hidden by the roofing board 6. Accordingly, workability improves by easy alignment of the reference ink 54 with a predetermined position of the outrigger 21. Then, as shown in FIG. 7, the rafter joining tool 55 as a long screw is driven from above the roofing board 6 into the purlin 23 at a portion in contact with the rafter receiver 26 while penetrating the rafter 5. In this manner, the one roof panel 40*a* is fixed to the outrigger 21 and the purlin 23.

Next, as shown in FIG. 10, the other roof panel 40*b* is disposed on the upstream side of the one roof panel 40*a*, and placed on the rafter receivers 26 fixed to the purlins 23 and the rafter stand 24 on the upper part of the ridge 22. At this time, a part of each of the rafters 5 on the downstream side is disposed between the carry-out portions 53 of the one roof panel 40*a*, and the roofing board 6 of the one roof panel 40*a* and the roofing board 6 of the other roof panel 40*b* are brought into abutment with each other. Subsequently, by procedures similar to the procedures of the one roof panel 40*a*, the upstream end of the rafter 5 is fitted into the rafter stand 24 of the ridge 22, and the other roof panel 40*b* and the ridge 22 are integrally connected and fixed to each other from above the roofing board 6 using the rafter joining tool 55 as a long screw. Thereafter, as shown in FIG. 9, the rafter joining tools 55 as long screws are driven into the rafters 5 at the positions in contact with the rafter receiver 26 of the purlin 23 from above the roofing board 6 to fix the other roof panel 40*b* to the purlin 23 and the ridge 22.

In this manner, as shown in FIG. 8, the roof panels 40 each fixed onto the horizontal base materials 2 constituted by the outrigger 21, the purlins 23, and the ridge 22 are connected to each other by driving the plurality of joining fixing tools 44 from above into positions where the roofing board 6 of the other roof panel 40*b* and the carry-out portions 53 of the one roof panel 40*a* are aligned with each other. Then, as shown in FIG. 11, each of the roof panels 40 is horizontally set by similar procedures, and an eave edge purlin 34 are fixed to eave side ends of the rafters 5 by screws. In addition, an eave edge roofing board 51 for eave edges is set at projecting ends of the rafters 5 from the eave edges and the upper parts of the eave edge purlins 34. Finally, an end roofing board 52 is set between a gable-side edge of the other roof panel 40*b* located at a gable-side end of the roof surface and longitudinal edges of the purlin 23 and the ridge 22 to complete the roof structure 11.

As described above, according to the roof structure 11 of the first embodiment, the interval between the rafters 5 of the roof panels 40*a* and 40*b* can be reduced by alternately disposing a part of the rafters 5 of the one roof panel 40*a* and the rafters 5 of the other roof panel 40*b*. Therefore, structural strength of the joining portions of the respective rafters 5 can be raised without joining the ends of the respective rafters 5. As a result, workability significantly improves. In addition, the joining portions of the roofing board 6 and the joining portions of the rafters 5 are not aligned with each other. Accordingly, the roof structure 11 to be provided can be easily constructed while maintaining structural strength required for the roof by supplementing structural weaknesses.

Second Embodiment

Next, a roof structure 12 according to a second embodiment will be described. Components similar to corresponding components of the roof structure 11 of the first embodiment are given the same reference numerals, and description of these components will be omitted. The roof structure 12 of the second embodiment includes the roof panels 40 having three types and disposed side by side in the slope direction. According to the present embodiment, each of two types of roof panels 40*c* and 40*d* except for a roof panel 40*e* closest to the ridge side has the roofing board 6 and the plurality of rafters 5. The rafters 5 project from the upstream edge of the roofing board 6 to form the carry-out portions 53 as shown in FIG. 12. Each of the carry-out portions 53 has a projection length of 500 mm.

The roof panel 40*c* located closest to the eave side in the two roof panels 40*c* and 40*d* has the rafters 5 projecting from the downstream edge of the roofing board 6. The projecting portion of the rafter 5 toward the downstream side is fixed to the outrigger 21. The rafters 5 of the roof panel 40*d* located between the roof panel 40*e* closest to the ridge side and the roof panel 40*c* closest to the eave side do not project from the roofing board 6 toward downstream side. The carry-out portions 53 are provided only on the upstream side. In addition, the roof panel 40*e* closest to the ridge side has the same configuration as that of the other roof panel 40*b* in the first embodiment. The rafters 5 of the roof panel 40*e* do not project from both edges of the roofing board 6, but are aligned with the edges of the roofing board 6.

The roofing board 6 of the intermediate roof panel 40*d* is disposed on the carry-out portions 53 provided on the upstream side of the roof panel 40*c* closest to the eave side while covering the carry-out portions 53. In addition, the rafters 5 of the intermediate roof panel 40*d* are disposed such that the carry-out portions 53 are sandwiched between the rafters 5. The joining fixing tools 44 are driven into the carry-out portions 53 of the roof panel 40*c* closest to the eave side from above the roofing board 6 of the intermediate roof panel 40*d* to join the carry-out portions 53 of the roof panel 40*c* closest to the eave side and the roofing board 6 of the intermediate roof panel 40*d*. In addition, the roofing board 6 of the roof panel 40*e* closest to the ridge side is disposed on the carry-out portions 53 provided on the upstream side of the intermediate roof panel 40*d* while covering the carry-out portions 53. Moreover, the rafters 5 of the roof panel 40*e* closest to the ridge side are disposed such that the carry-out portions 53 are sandwiched between the rafters 5. The joining fixing tools 44 are driven into the carry-out portions 53 of the intermediate roof panel 40*d* from above the roofing board 6 of the roof panel 40*e* closest to the ridge side to join the carry-out portions 53 of the intermediate roof panel 40*d* and the roofing board 6 of the roof panel 40*e* closest to the ridge side. The rafters 5 of the respective roof panels 40, the outrigger 21, the purlins 23, and the ridge 22 are joined by the rafter joining tools 55 as long screws driven from above the roofing board 6 similarly to the first embodiment.

According to the relationship between the roof panel 40*c* closest to the eave side and the intermediate roof panel 40*d* in the roof panels 40 of the present embodiment, the roof panel 40*c* closest to the eave side corresponds to "one roof panel" in the present invention, while the intermediate roof panel 40*d* corresponds to "the other roof panel" in the present invention. In addition, according to the relationship between the intermediate roof panel 40*d* and the roof panel 40*e* closest to the ridge side, the intermediate roof panel 40*d* corresponds to "one roof panel" in the present invention, while the roof panel 40*e* closest to the ridge side in the present invention corresponds to "the other roof panel".

As described above, each of the roof panels 40*c* and 40*d* on the downstream side except for the roof panel 40*e* closest to the ridge side has the carry-out portions 53 each projecting toward the upstream side, and the carry-out portions 53 are disposed and fixed between the rafters 5 of the roof panel 40 adjacent on the upstream side. Accordingly, an increase in the roof size can be handled by arranging the plurality of roof panels 40 in the slope direction. While the three roof panels 40 are disposed side by side in the slope direction in the example presented in the second embodiment, the four or more roof panels 40 may be disposed side by side in the slope direction. In this case, a plurality of the intermediate roof panels 40*d* in the present embodiment are disposed between the roof panel 40*e* closest to the ridge side and the roof panel 40*c* closest to the eave side.

Third Embodiment

Next, a roof structure 13 according to a third embodiment will be described. Components similar to corresponding components of the roof structures 11 and 12 of the first and second embodiments are given the same reference numerals, and description of these components will be omitted. The roof structure 13 of the third embodiment includes the roof panels 40 having three types and disposed side by side in the slope direction similarly to the second embodiment. According to the present embodiment, a roof panel 40*h* on the upstream side and closest to the ridge side has the carry-out portions 53 projecting from the roofing board 6 toward the downstream side. Moreover, a roof panel 40*f* on the downstream side and closest to the eave side has the carry-out portions 53 projecting from the roofing board 6 toward the upstream side. Furthermore, a roof panel 40*g* which includes the rafters 5 having upstream and downstream ends projecting from the edges of the roofing board 6 is disposed between the roof panel 40*h* on the upstream side and the roof panel 40*f* on the downstream side.

The roofing board 6 of the intermediate roof panel 40*g* is disposed on the carry-out portions 53 projecting toward the upstream side of the roof panel 40*f* on the downstream side, and covers the carry-out portions 53. The rafters 5 of the intermediate roof panel 40*g* are disposed such that the carry-out portions 53 are sandwiched between the rafters 5. The joining fixing tools 44 are driven into the carry-out portions 53 of the roof panel 40*f* on the downstream side from above the roofing board 6 of the intermediate roof panel 40*g* to join the carry-out portions 53 of the roof panel 40*f* on the downstream side and the roofing board 6 of the intermediate roof panel 40*g*. In addition, the roofing board 6 of the intermediate roof panel 40*g* is disposed on the carry-out portions 53 projecting toward the downstream side of the roof panel 40*h* on the upstream side, and covers the carry-out portions 53. The rafters 5 of the intermediate roof panel 40*g* are disposed such that the carry-out portions 53 are sandwiched between the rafters 5. The joining fixing tools 44 are driven into the carry-out portions 53 of the roof panel 40*h* on the upstream side from above the roofing board 6 of the intermediate roof panel 40*g* to join the carry-out portions 53 of the roof panel 40*h* on the upstream side and the roofing board 6 of the intermediate roof panel 40*g*.

As described above, according to the roof structure 13, the necessity of applying complicated processing to the ends of the rafters 5 to join the rafters 5 with each other as conventionally performed is eliminated by alternately arranging a part of the respective rafters 5. Accordingly, workability greatly improves even in a case of a large roof having a long length. In addition, the joining portions of the roofing board 6 and the joining portions of the rafters 5 are not aligned with each other. Accordingly, the roof structure 13 to be provided can be easily constructed while maintaining structural strength required for the roof by supplementing structural weaknesses. Moreover, the intermediate roof panel 40*g* is dropped from above after determining a most downstream position and a most upstream position using the roof panel 40*f* on the downstream side and the roof panel 40*h* on the upstream side. Accordingly, deviation of the roof panels 40 around the eaves and ridges is avoidable.

Fourth Embodiment

A roof structure 1 according to an embodiment of the present invention will be hereinafter described with reference to the respective drawings. The roof structure 1 shown in FIG. 14 is a structure mainly used for a slope roof having a wooden structure, and includes a plurality of the horizontal base materials 2 disposed in parallel with each other with a clearance left between each other and extending in an outrigger direction, a roof panel 3, and a receiving roof panel 4 disposed on the upstream side with respect to the roof panel 3.

As shown in FIG. 14, the horizontal base materials 2 are a plurality of long members disposed substantially parallel to each other with a clearance left between each other while producing a height difference along the roof slope, and extending in the outrigger direction while supported by not-shown pillars and posts. The roof panel 3 and the receiving roof panel 4 are placed on the upper parts of the horizontal base materials 2. According to the example shown in the figure, the horizontal base materials 2 are constituted by the outrigger 21 disposed on the most downstream side, the ridge 22 disposed on the most upstream side, and a plurality of the purlins 23 disposed between and in parallel to the outrigger 21 and the ridge 22. An interval L1 between the respective horizontal base materials 2 is calculated and determined by structural calculation in consideration of a roof shape, a climate of each region, a load acting on the roof, and the like. For example, a vertical distance between the purlins 23 may be set approximately in a range from 1500 mm to 2000 mm. Note that the arrangement of the horizontal base materials 2 in FIG. 14 is presented by way of example. The type and shape of the horizontal base materials 2, and the number of the purlins 23 are not particularly limited.

As shown in FIGS. 14 and 18, a rafter stand 2*a* for receiving first rafters 32 and second rafters 42, which will be described below, is fixed to each of the upper surfaces of the outrigger 21 and the ridge 22. A notch 2*b* having a substantially triangular cross-sectional shape as shown in FIG. 20 is formed in the rafter stand 2*a* at each point of contact with the rafters 32 and 42. Moreover, as shown in FIGS. 18 and 22, a rafter receiver 23*a* having a trapezoidal cross section and an upper surface sloped in accordance with the roof slope is fixed to the downstream side surface of each of the purlins 23 using a fixing tool A such as a screw and a nail. In this manner, the respective rafters 32 and 42 can be placed in a stable manner.

The roof panel 3 is a composite panel which includes a roofing board and rafters integrated with each other beforehand in a factory, and includes a first roofing board 31, and a plurality of first rafters 32 fixed to a lower surface 31*a* of the first roofing board 31 in parallel to each other with a clearance left between each other as shown in FIG. 15. The first field material 31 is constituted by structural plywood having a thickness of approximately 12 mm, and sized to have a width of approximately 2000 mm or smaller and a length of approximately 3000 mm to 4000 mm or smaller.

The roof panel 3 in this size can be lifted by a crane without any problem and placed in a predetermined position during construction, and can be easily transported. Each of the first rafters 32 is connected and fixed to the first roofing board 31 by a plurality of fixing tools A driven from above the first roofing board 31. One end of each of the first rafters 32 projects from one edge 31*b* of the first roofing board 31. A projection length L2 of a first projection portion 32*a*, which is the foregoing projection portion, is equal to or larger than the interval L1 between the adjacent horizontal base materials 2 shown in FIG. 14. In addition, an opposite end 32*b* of each of the first rafters 32 is a portion projecting from an opposite edge 31*c* of the first roofing board 31 and forming an eave, and is placed on the outrigger 21 as shown in FIG. 14. As shown in FIG. 20, reference ink 32*d* is marked on a side surface 32*c* of the opposite end 32*b* at a portion in contact with the outrigger 21 to equalize projections of eaves. A projection width of the opposite end 32*b* from the first roofing board 31 is determined by projections of eaves for each roof. Note that the opposite end 32*b* of the first rafter 32 does not project from the opposite edge 31*c* of the first roofing board 31 when the roof panel 3 is not set at the most downstream position.

As shown in FIG. 14, it is preferable that the roof panel 3 is fixed on the horizontal base materials 2 with the first projection portion 32*a* side of the first rafters 32 facing the upstream side, and that the total length of the roof panel 3 is at least twice to three times larger than the interval L1 between the horizontal base materials 2. For forming a roof having large projections of eaves as shown in FIG. 16, reinforcing rafters 33 may be provided adjacent to the opposite ends 32*b* of the plurality of first rafters 32 except for both ends to reinforce strength of the eaves. While not shown in the figures, each of the reinforcing rafters 33 has such a length that the opposite end of the reinforcing rafter 33 can reach the purlin 23 adjacent to the ridge 21 in a state where an edge of one end of the reinforcing rafter 33 is aligned with an edge of the opposite end 32*b*.

An interval between the adjacent first rafters 32 is preferably 500 mm or smaller in accordance with positioning standards for the horizontal base materials specified in "Allowable stress design of wooden frame construction method housing (2017 version)". In addition, the intervals between the plurality of first rafters 32 are preferably equal intervals in consideration of allocation easiness and workability, but are not necessarily limited to equal intervals as long as each interval is 500 mm or smaller.

Similarly to the roof panel 3, the receiving roof panel 4 is a composite panel which includes a roofing board and rafters integrated with each other beforehand in a factory, and includes a second roofing board 41, and a plurality of second rafters 42 fixed to a lower surface 41*a* of the second roofing board 41 in parallel to each other with a clearance left between each other as shown in FIG. 17. Each of the second rafters 42 is connected and fixed to the second roofing board 41 by a plurality of the fixing tools A driven from above the second roofing board 41. One and opposite ends of each of the second rafters 42 are disposed at one edge 41*b* and an opposite edge 41*c* of the second roofing board 41, respectively. Unlike the roof panel 3, both ends 42*a* and 42*b* of the second rafter 42 do not protrude from the second roofing board 41. As shown in FIG. 14, the receiving roof panel 4 is a panel overlapped on the upper parts of the first projection portions 32*a*. It is preferable that the total length of the receiving roof panel 4 is at least twice larger than the interval L2 between the horizontal base materials 2. Note that the configuration of the second roofing board 41 and the interval between the second rafters 42 are similar to the configuration of the first field material 31 and the interval between the first rafters 32.

Next, a construction method of the roof structure 1 will be described. First, as shown in FIG. 18, the roof panel 3 is spanned on the horizontal base materials 2 extended on not-shown pillars and posts. The roof panel 3 is placed on the rafter stand 2*a* at the upper part of the outrigger 21 and the rafter receivers 23*a* fixed to the purlins 23 in a state where the first projection portions 32*a* of the first rafters 32 face the upstream side. The opposite end 32*b* of the first rafter 32 is fitted into the notch 2*b* of the rafter stand 2*a* as shown in FIG. 20. Then, after aligning the reference ink 32*d* and a downstream side corner of the rafter stand 2*a* to equalize the projection width of the opposite end 32*b* from the outrigger 21, the opposite end 32*b* and the outrigger 21 are integrally connected and fixed from above by a long screw B as shown in FIG. 21. At this time, the reference ink 32*d* is not hidden by the first roofing board 31. Accordingly, workability improves by easy alignment of the reference ink 32*d* with a predetermined position of the outrigger 21. Moreover, as shown in FIG. 22, the long screw B is driven from above the first roofing board 31 into the first rafter 32 at a portion in contact with the rafter receiver 23*a* to sequentially fix the roof panel 3 to the horizontal base materials 2.

Subsequently, as shown in FIGS. 14 and 19, the receiving roof panel 4 is placed on the rafter receivers 23*a* fixed to the purlins 23 located on the upstream side with respect to the first roofing board 31, and on the rafter stand 2*a* on the upper part of the ridge 22. At this time, the one end 42*a* of each of the second rafters 42 is disposed between the adjacent first projection portions 32*a*, and the one edge 41*b* of the second roofing board 41 is brought into abutment with the one edge 31*b* of the first roofing board 31. Then, the opposite end 42*b* of each of the second rafters 42 is fitted into the rafter stand 2*a* of the ridge 22 by procedures similar to the procedures of the roof panel 3. As shown in FIG. 23, the receiving roof panel 4 and the ridge 22 are integrally connected and fixed from above the second roofing board 41 by the long screws B, and the receiving roof panel 4 is fixed to the horizontal base materials 2 by driving the long screws B from above the second roofing board 41 into the second rafters 42 in contact with the rafter receivers 23*a*.

In this manner, the roof panel 3 and the receiving roof panel 4 fixed onto the horizontal base materials 2 are connected to each other by driving a plurality of fixing tools A from above into positions where the second roofing board 41 and the first projection portions 32*a* of the first rafters 32 are aligned with each other as shown in FIG. 23. Then, as shown in FIG. 24, each of the roof panel 3 and the receiving roof panel 4 is horizontally set by similar procedures, and the eave edge purlin 34 are fixed to tips of the opposite ends 32*b* of the first rafters 32 by screws. In addition, the eave edge roofing board 51 for eave edges is set at the opposite ends 32*b* of the first rafters 32 projecting from the eave edges and the upper parts of the eave edge purlin 34. Finally, the end roofing board 52 is set between a gable-side edge of the receiving roof panel 4 located at a gable-side end of the roof surface and longitudinal edges of the horizontal base materials 2 to complete the roof structure 1.

As described above, according to the roof structure 1, the intervals between the rafters 32 and 42 of the respective panels 3 and 4 can be reduced by alternately arranging a part of the first rafters 32 and the second rafters 42. Therefore, structural strength of the joining portions of the respective rafters 32 and 42 can be raised without joining the ends of the respective rafters 32 and 42. As a result, workability significantly improves. In addition, the joining portions of the roofing board and the joining portions of the rafters are not aligned with each other. Accordingly, the roof structure to be provided can be easily constructed while maintaining structural strength required for the roof by supplementing structural weaknesses. Moreover, while only the one roof panel 3 is used in the example shown in the figure, the receiving roof panel 4 may be fixed to the first projection portions 32*a* of the roof panel 3 located on the most upstream side in a state where the first roofing boards 31 of the plurality of roof panels 3 abut on and join each other as shown in FIG. 25. The number of the roof panels 3 can be adjusted according to the shape and size of the roof.

Fifth Embodiment

Next, a roof structure 6 according to an embodiment of the present invention will be described with reference to the respective drawings. Note that configurations identical to the configurations of the roof structure 1 are given similar reference numbers, and the same explanation is omitted. As shown in FIG. 26, the roof structure 6 includes a plurality of the horizontal base materials 2, the roof panel 3, the receiving roof panel 4, and a second roof panel 7 disposed on the upstream side with respect to the receiving roof panel 4.

As shown in FIG. 26, the second roof panel 7 as a composite panel which includes a roofing board and rafters integrated with each other includes a third roofing board 71 which has one edge 71*a* abutting on the opposite edge 41*c* of the second roofing board 41, and a plurality of third rafters 72 fixed to a lower surface of the third roofing board 71 in parallel to each other with a clearance left between each other. Each of the third rafters 72 has one end projecting from the one edge 71*a* of the third roofing board 71. A projection length L3 of a second projection portion 72*a* corresponding to this projection portion is equal to or larger than the interval L1 between the adjacent horizontal base materials 2 shown in FIG. 14. Note that the configuration of the third roofing board 71 and the interval between the third rafters 72 are similar to the configuration of the first roofing board 31 and the interval between the first rafters 32.

Next, a roof structure construction method using the roof structure 6 will be described. First, the roof panel 3 is fixed to the horizontal base materials 2 by procedures similar to the corresponding procedures of the fourth embodiment. Then, as shown in FIG. 26, an opposite end 72*b* of the third rafter 72 is fitted into the not-shown notch 2*c* of the rafter stand 2*a* placed on the upper part of the ridge 22 with the second projection portion 72*a* facing the downstream side, and the third rafters 72 are placed on the rafter receivers 23*a* fixed to the purlins 23. Then, the opposite end 72*b* and the ridge 22 are integrally connected and fitted to each other by driving the long screws B (not shown) from above. In addition, the second roof panel 7 is sequentially fixed to the horizontal base materials 2 by driving the long screws B (not shown) from above the third roofing board 71 into the third rafters 72 at portions in contact with the rafter receivers 23*a*. At this time, note that the shape of the second roof panel 7 is adjusted such that the third rafters 72 are set on the horizontal base materials 2 substantially in such positions as to be aligned with the positions of the first rafters 32 in the outrigger direction, and that a separation distance between the first roofing board 31 and the third roofing board 71 is substantially equal to the length of the second roofing board 41.

Subsequently, as shown in FIG. 26, the receiving roof panel 4 is placed on the rafter receivers 23*b* fixed to the purlins 23 located between the first roofing board 31 and the third roofing board 71. At this time, the second rafters 42 are disposed such that the one ends 42*a* are located between the first projection portions 32*a* of the first rafters 32, and that the opposite ends 42*b* are disposed between the second projection portions 72*a* of the third rafters 72. The both ends 41*b* and 41*c* of the second roofing board 41 are brought into abutment with the one edge 31*b* of the first roofing board 31 and the one edge 71*a* of the third roofing board 72, respectively. Then, similarly to the second roof panel 7, the long screws B (not shown) are driven from above into the second rafters 42 at portions in contact with the rafter receivers 23*a* to fix the receiving roof panel 4 to the horizontal base materials 2.

In this manner, the receiving roof panel 4 disposed on the horizontal base materials 2 are connected by driving the fixing tools A from above into the second roofing board 41 at positions where the first projection portions 32*a* and the second projection portions 72*a* are aligned with each other as shown in FIG. 27. Then, the eave edge roofing board 51, the eave edge purlin 34, and the end roofing board 52 are set by procedures similar to the corresponding procedures of the roof structure 1 to complete the roof structure 6.

As described above, according to the roof structure 6, the necessity of applying complicated processing to the ends of the rafters to join the rafters with each other as conventionally performed is eliminated by alternately arranging a part of the respective rafters 32, 42, and 72. Accordingly, workability greatly improves even in a case of a large roof having a large length. In addition, the joining portions of the roofing board and the joining portions of the rafters are not aligned with each other. Accordingly, the roof structure to be provided can be easily constructed while maintaining structural strength required for the roof by supplementing structural weaknesses. Moreover, the receiving panel 4 is dropped from above after determining a most downstream position and a most upstream position using the roof panel 3 and the second roof panel 7. Accordingly, deviation of the respective roof panels around the eaves and ridges is avoidable.

The embodiment of the present invention is not limited to the embodiments described above, but may be appropriately changed without departing from the scope of the spirit of the present invention.

INDUSTRIAL APPLICABILITY

A roof panel according to the present invention is suitably applicable to formation of a sloped roof having a wooden structure.

DESCRIPTION OF REFERENCE SIGNS

1, 6, 11, 12, 13 roofing board
2 horizontal base materials
3 roof panel
31 first roofing board
31*b* one edge of the first roofing board
32 first rafters
32*a* first projection portion
4 receiving roof panel
41 second roofing board
41*b* one edge of the second roofing board
41*c* opposite edge of the second roofing board
42 second rafters
42*a* one end of each of the second rafters

42*b* opposite end of each of the second rafters
5 rafters
6 roofing board
40 roof panel
53 carry-out portions
7 second roof panel
71 third roofing board
71*a* one edge of the third roofing board
72 third rafters
72*a* second projection portion
L1 the interval between the adjacent horizontal base materials
L2 projection length of a first projection portion
L3 projection length of a second projection portion

The invention claimed is:

1. A roof structure comprising:

a plurality of horizontal base materials disposed in parallel to each other with a clearance left between each other, and so disposed as to produce a height difference that forms a roof slope; and a plurality of roof panels fixed on the plurality of horizontal base materials and spread side by side in a slope direction, wherein each of the plurality of roof panels includes a roofing board, and rafters fixed to a lower surface of the roofing board in parallel to each other with a clearance left between each other, and extending perpendicularly to the plurality of horizontal base materials, each of the rafters of one roof panel of two adjacent roof panels in the slope direction includes a carry-out portion that projects from an edge of the roofing board, each of the carry-out portions is disposed between the rafters of another roof panel of the two adjacent roof panels and fixed to the roofing board of the another roof panel, a projection length of the carry-out portions is smaller than a distance between adjoining horizontal base materials, the carry-out portions and the roofing board of the another roof panel are fixed to a same horizontal base material of the plurality of horizontal base materials, ends of the roofing board of the one roof panel and the another roof panel are disposed in abutment with each other, the roofing board of the another roof panel covers the carry-out portions of the one roof panel, and the carry-out portions of the one roof panel are fixed to the horizontal base material by a rafter joining tool penetrating the roofing board of the another roof panel and the carry-out portions of the one roof panel, and the carry-out portions of the one roof panel and the rafters of the another roof panel are alternately disposed at equal intervals.

2. The roof structure according to claim 1, wherein the one roof panel is fixed to the plurality of horizontal base materials with the carry-out portions facing an upstream side, and the another roof panel is disposed on the upstream side of the one roof panel and fixed to the plurality of horizontal base materials.

3. The roof structure according to claim 2, wherein the roof structure includes the three or more roof panels disposed side by side in the slope direction, each of the plurality of roof panels located on a downstream side except for a roof panel located closest to a ridge side includes the carry-out portions that project toward the upstream side, and each of the carry-out portions is disposed and fixed between the rafters of a roof panel adjacent on the upstream side.

4. A roof structure construction method for constructing the roof structure according to claim 3, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the another roof panel to fix the one roof panel and the another roof panel.

5. The roof structure according to claim 2, wherein the roof structure includes the three or more roof panels disposed side by side in the slope direction, a roof panel on the upstream side includes the carry-out portions that project toward the downstream side, a roof panel on the downstream side includes the carry-out portions that project toward the upstream side, and a roof panel that is an intermediate roof panel located between the roof panel on the upstream side and the roof panel on the downstream side is disposed such that an upstream end and a downstream end of each of the rafters do not project from an edge of the roofing board.

6. A roof structure construction method for constructing the roof structure according to claim 5, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the another roof panel to fix the one roof panel and the another roof panel.

7. A roof structure construction method for constructing the roof structure according to claim 5, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the another roof panel to fix the one roof panel and the another roof panel.

8. A roof structure construction method for constructing the roof structure according to claim 2, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the another roof panel to fix the one roof panel and the another roof panel.

9. A roof structure construction method for constructing the roof structure according to claim 2, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the other roof panel to fix the one roof panel and the other roof panel.

10. A roof structure construction method for constructing the roof structure according to claim 1, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the another roof panel to fix the one roof panel and the another roof panel.

11. A roof structure construction method for constructing the roof structure according to claim 1, comprising:

fixing the one roof panel to the plurality of horizontal base materials, and then disposing the another roof panel such that the roofing board of the another roof panel covers the carry-out portions of the one roof panel, and bringing ends of the roofing boards of the one roof panel and the another roof panel into abutment with each other; and driving a fixing tool into each of the carry-out portions from above the roofing board of the another roof panel to fix the one roof panel and the another roof panel.

12. A roof structure comprising:

a plurality of horizontal base materials disposed in parallel to each other with a clearance left between each other and extending in an outrigger direction;

a roof panel comprising a first roofing board, and a plurality of first rafters fixed to a lower surface of the first roofing board in parallel to each other with a clearance left between each other, and projecting from at least one edge of the first roofing board, the roof panel being fixed to upper parts of a plurality of horizontal base materials disposed in parallel to each other with a clearance left between each other, wherein a projection length of a first projection portion included in each of the plurality of first rafters and projecting from an edge of the first roofing board is equal to or larger than an interval between adjoining horizontal base materials; and a receiving roof panel comprising a second roofing board disposed with one edge of the second roofing board abutting on one edge of the first roofing board, and a plurality of second rafters fixed to a lower surface of the second roofing board in parallel to each other with a clearance left between each other, and disposed such that at least one end of each of the plurality of second rafters is disposed at one edge of the second roofing board, wherein the roof panel is fixed to the plurality of horizontal base materials with the first projection portions facing an upstream side, tips of the first protrusion portions being in contact with horizontal base materials disposed with a clearance left between each other next to horizontal base materials disposed in the position of the edge of the first roofing board, and the receiving roof panel is fixed to the plurality of horizontal base materials with one end of each of the second rafters disposed between the adjacent first projection portions.

13. The roof structure according to claim 12, further comprising:

a second roof panel that includes:

a third roofing board disposed with one edge of the third roofing board abutting on an opposite edge of the second roofing board, and a plurality of third rafters fixed to a lower surface of the third roofing board in parallel to each other with a clearance left between each other, and disposed such that one end of each of the plurality of third rafters projects from one edge of the third roofing board, wherein the second roof panel is fixed to the plurality of horizontal base materials located on a most upstream side in a state where a second projection portion included in each of the plurality of third rafters and projecting from an edge of the third roofing board faces a downstream side, and the receiving roof panel is fixed to the plurality of horizontal base materials in a state where an opposite end of each of the plurality of second rafters are disposed between adjacent second projection portions.

14. A roof structure construction method using the roof structure according to claim 13, comprising:

fixing the roof panel to the plurality of horizontal base materials with the first projection portion of each of the plurality of first rafters facing the upstream side;

bringing one edge of the second roofing board into abutment with one edge of the first roofing board from above; and fixing the receiving roof panel to the plurality of horizontal base materials with one end of each of the plurality of second rafters disposed between the first projection portions, and fixing the second roofing board to the first projection portions.

15. The roof structure construction method according to claim 14, comprising:

bringing one edge and another edge of the second roofing board into abutment with one edge of the first roofing board and one edge of the third roofing board from above, respectively, after the second roof panel is fixed to the plurality of horizontal base materials located on the most upstream side with the second projection portion of each of the plurality of third rafters facing the downstream side;

fixing the receiving roof panel to the plurality of horizontal base materials with one end of each of the plurality of second rafters disposed between the first projection portions and with the opposite end of each of the plurality of second rafters disposed between the second projection portions; and fixing the second roofing board to the first projection portions and the second projection portions.

16. A roof structure construction method using the roof structure according to claim 1, comprising:

fixing the roof panel to the plurality of horizontal base materials with the first projection portion of each of the first rafters facing the upstream side;

bringing one edge of the second roofing board into abutment with one edge of the first roofing board from above; and fixing the receiving roof panel to the plurality of horizontal base materials with one end of each of the second rafters disposed between the first projection portions, and fixing the second roofing board to the first projection portions.

17. A roof structure construction method using the roof structure according to claim 12, comprising:

fixing the roof panel to the plurality of horizontal base materials with the first projection portion of each of the plurality of first rafters facing the upstream side;

bringing one edge of the second roofing board into abutment with one edge of the first roofing board from above; and fixing the receiving roof panel to the plurality of horizontal base materials with one end of each of the plurality of second rafters disposed between the first projection portions, and fixing the second roofing board to the first projection portions.

18. The roof structure construction method according to claim 17, comprising:

bringing one edge and another edge of the second roofing board into abutment with one edge of the first roofing board and one edge of the third roofing board from above, respectively, after the second roof panel is fixed to the plurality of horizontal base materials located on the most upstream side with the second projection portion of each of the plurality of third rafters facing the downstream side;

fixing the receiving roof panel to the plurality of horizontal base materials with one end of each of the plurality of second rafters disposed between the first projection portions and with the opposite end of each of the plurality of second rafters disposed between the second projection portions; and fixing the second roofing board to the first projection portions and the second projection portions.

19. A roof structure construction method using the roof structure according to claim 12, comprising:

fixing the roof panel to the plurality of horizontal base materials with the first projection portion of each of the plurality of first rafters facing the upstream side;

bringing one edge of the second roofing board into abutment with one edge of the first roofing board from above; and fixing the receiving roof panel to the plurality of horizontal base materials with one end of each of the plurality of second rafters disposed between the first projection portions, and fixing the second roofing board to the first projection portions.

20. The roof structure construction method according to claim 19, comprising:

bringing one edge and another edge of the second roofing board into abutment with one edge of the first roofing board and one edge of the third roofing board from above, respectively, after the second roof panel is fixed to the plurality of horizontal base materials located on the most upstream side with the second projection portion of each of the plurality of third rafters facing the downstream side;

fixing the receiving roof panel to the plurality of horizontal base materials with one end of each of the plurality of second rafters disposed between the first projection portions and with the opposite end of each of the plurality of second rafters disposed between the second projection portions; and fixing the second roofing board to the first projection portions and the second projection portions.

* * * * *